US011780701B2

(12) United States Patent
Kobayashi et al.

(10) Patent No.: US 11,780,701 B2
(45) Date of Patent: Oct. 10, 2023

(54) SHEET PROCESSING APPARATUS AND IMAGE FORMING SYSTEM

(71) Applicants: Daichi Kobayashi, Yamanashi (JP); Takuya Katayama, Yamanashi (JP); Koji Kanda, Yamanashi (JP)

(72) Inventors: Daichi Kobayashi, Yamanashi (JP); Takuya Katayama, Yamanashi (JP); Koji Kanda, Yamanashi (JP)

(73) Assignee: CANON FINETECH NISCA INC., Misato (JP)

( * ) Notice: Subject to any disclaimer, the term of this patent is extended or adjusted under 35 U.S.C. 154(b) by 0 days.

(21) Appl. No.: 17/852,564

(22) Filed: Jun. 29, 2022

(65) Prior Publication Data

US 2022/0411225 A1 Dec. 29, 2022

(30) Foreign Application Priority Data

Jun. 29, 2021 (JP) ..... 2021-107669

(51) Int. Cl.
*B65H 45/16* (2006.01)
*G03G 15/00* (2006.01)

(52) U.S. Cl.
CPC ..... *B65H 45/16* (2013.01); *G03G 15/6582* (2013.01); *B65H 2553/00* (2013.01)

(58) Field of Classification Search
CPC . G03G 2215/00877; B31F 1/10; B41L 43/06; B65H 45/18; B65H 45/20; B65H 37/06; B65H 2301/4505
USPC ..... 493/442, 443, 444, 445; 270/32, 37
See application file for complete search history.

(56) References Cited

U.S. PATENT DOCUMENTS 5,054,757 A * 10/1991 Martin ..... B65H 45/145 270/45
6,719,680 B2 * 4/2004 Hosoya ..... B65H 45/142 493/434
6,846,280 B2 * 1/2005 Fukasawa ..... B65H 45/18 493/434
7,594,645 B2 * 9/2009 Suzuki ..... B65H 37/00 270/32
8,529,423 B2 * 9/2013 Imazu ..... B65H 45/142 270/32
8,771,159 B2 * 7/2014 Imazu ..... B65H 45/145 493/320
8,939,880 B2 * 1/2015 Yamaya ..... B65H 45/144 493/420
9,108,821 B2 * 8/2015 Nakada ..... B65H 45/12
(Continued)

FOREIGN PATENT DOCUMENTS

JP 2002-226134 A 8/2002
JP 2012-056674 A 3/2012
JP 2017-114648 A 6/2017

*Primary Examiner* — Leslie A Nicholson, III
(74) *Attorney, Agent, or Firm* — Manabu Kanesaka

(57) ABSTRACT

A sheet folding apparatus includes: a rotor having a first peripheral surface and a second peripheral surface with a radius smaller than that of the first peripheral surface and configured to convey a sheet; and a guide member configured to be movable between a first position where it guides a sheet being conveyed by the rotor and a second position retracting from the first position. The guide member is disposed so as to move from the second position to the first position while passing within the rotation locus of the first peripheral surface of the rotor.

14 Claims, 28 Drawing Sheets

(56) References Cited

U.S. PATENT DOCUMENTS

| | | | | |
|---|---|---|---|---|
| 10,203,644 | B2 * | 2/2019 | Endo | B31F 1/0051 |
| 11,203,506 | B2 * | 12/2021 | Katayama | B65H 37/06 |
| 11,275,335 | B2 * | 3/2022 | Katayama | B65H 45/18 |
| 11,294,318 | B2 * | 4/2022 | Katayama | B65H 37/06 |
| 11,370,634 | B2 * | 6/2022 | Katayama | B42C 1/12 |
| 2012/0275838 | A1 * | 11/2012 | Imazu | G03G 15/6582 493/454 |

* cited by examiner

SHEET PROCESSING APPARATUS AND IMAGE FORMING SYSTEM

TECHNICAL FIELD

The present invention relates to a sheet processing apparatus that applies folding processing to a sheet fed from, e.g., an image forming apparatus and an image forming system including the sheet processing apparatus and image forming apparatus.

BACKGROUND ART

There is conventionally known a sheet processing apparatus that folds a sheet bundle into a booklet shape as an apparatus performing post-processing for sheets discharged from an image forming apparatus, such as a copier, a printer, a facsimile device, or a compound machine thereof. An example of such a sheet processing apparatus includes one having a mechanism wherein sheets fed from an image forming apparatus and carried out to a sheet stacker are thrust at its predetermined position toward the nip portion of a folding roller pair with a thrust plate to pass between the folding roller pair to be folded.

A sheet processing apparatus described in Patent Document 1 performs inward threefold processing in which a sheet is subjected to folding processing at two different positions such that one end of the sheet is inside the folded part. Specifically, the sheet processing apparatuses described in Patent Document 1 conveys in a switchback manner a sheet that has been subjected to the first folding processing back to a stacker and then performs second folding processing at a position different from that in the first folding processing to thereby fold the sheet inward in three.

Further, the sheet processing apparatus disclosed in Patent Document 1 has a curling-up preventing member (guide member) that abuts against a sheet being conveyed in a switchback manner after the first folding processing by the folding roller pair to guide one end portion of the inwardly folded part of the sheet to the side on the stacker where the other end portion of the sheet is positioned. This prevents the sheet that is switchback-conveyed in the inward threefold processing from being directed to the side opposite to the side where the other end portion of the sheet is positioned and thus from being carried into the stacker in a curled-up (opened) state.

PRIOR ART DOCUMENT

Patent Document

[Patent Document 1] Japanese Unexamined Patent Publication No. 2012-056674

DISCLOSURE OF INVENTION

Problems to be Solved by the Invention

When the curling-up preventing member of JP 2012-056674A is positioned apart from the nip portion of the folding roller pair, that is, when the sheet conveyance distance from the nip portion to the curling-up preventing member is large, the time taken for the sheet to reach the curling-up preventing member increases to increase the amount of restoration of the folded part. As a result, the sheet does not abut against the curling-up preventing member adequately, which may prevent the sheet from being guided to a desired position.

It is therefore an object of the present invention to provide a sheet folding apparatus having a guide member capable of stably guiding a sheet that has been subjected to folding processing and is being switchback-conveyed such that one end potion of the sheet is guided to the side where the other end portion of the sheet is positioned.

Means for Solving the Problem

To achieve the above object, a representative configuration of the present invention is a sheet processing apparatus that applies folding processing to a sheet. The sheet processing apparatus includes: a conveying path having a guide surface for guiding a sheet being conveyed; a first rotor having a first peripheral surface with a constant radius and a second peripheral surface having a radius smaller than that of the first peripheral surface; a second rotor configured to be rotated in sync with the first rotor and brought into pressure contact with the first peripheral surface of the first rotor to form a nip part, the second rotor being rotated while holding a sheet conveyed to the conveying path at the nip part in the folding processing to convey the sheet in a first direction to apply the folding processing to the sheet and rotated while holding the folded sheet at the nip part to switchback-convey the sheet in a second direction opposite to the first direction; and a guide member configured to abut, in the conveying path, against the sheet that has been subjected to the folding processing and being moved in the second direction while being held by the nip part, to guide one end portion of the sheet to the side of the conveying path where the other end portion of the sheet is positioned. The guide member is configured to be turned between a first position substantially flush with the guide surface or separated from the conveying path than the guide surface and a second position abutting against the sheet in the conveying path and configured to enter an area between a rotation locus of the first peripheral surface and a rotation locus of the second peripheral surface when being turned from the first position to the second position and then to abut against the sheet at the second position outside that area.

Advantageous Effect of the Invention

According to the present invention, in the sheet folding apparatus, a sheet that has been subjected to folding processing and is being switchback-conveyed can be guided stably by a guide member such that one end potion of the sheet is guided to the side where the other end portion of the sheet is positioned.

MODE FOR CARRYING OUT THE INVENTION

Figure 1:
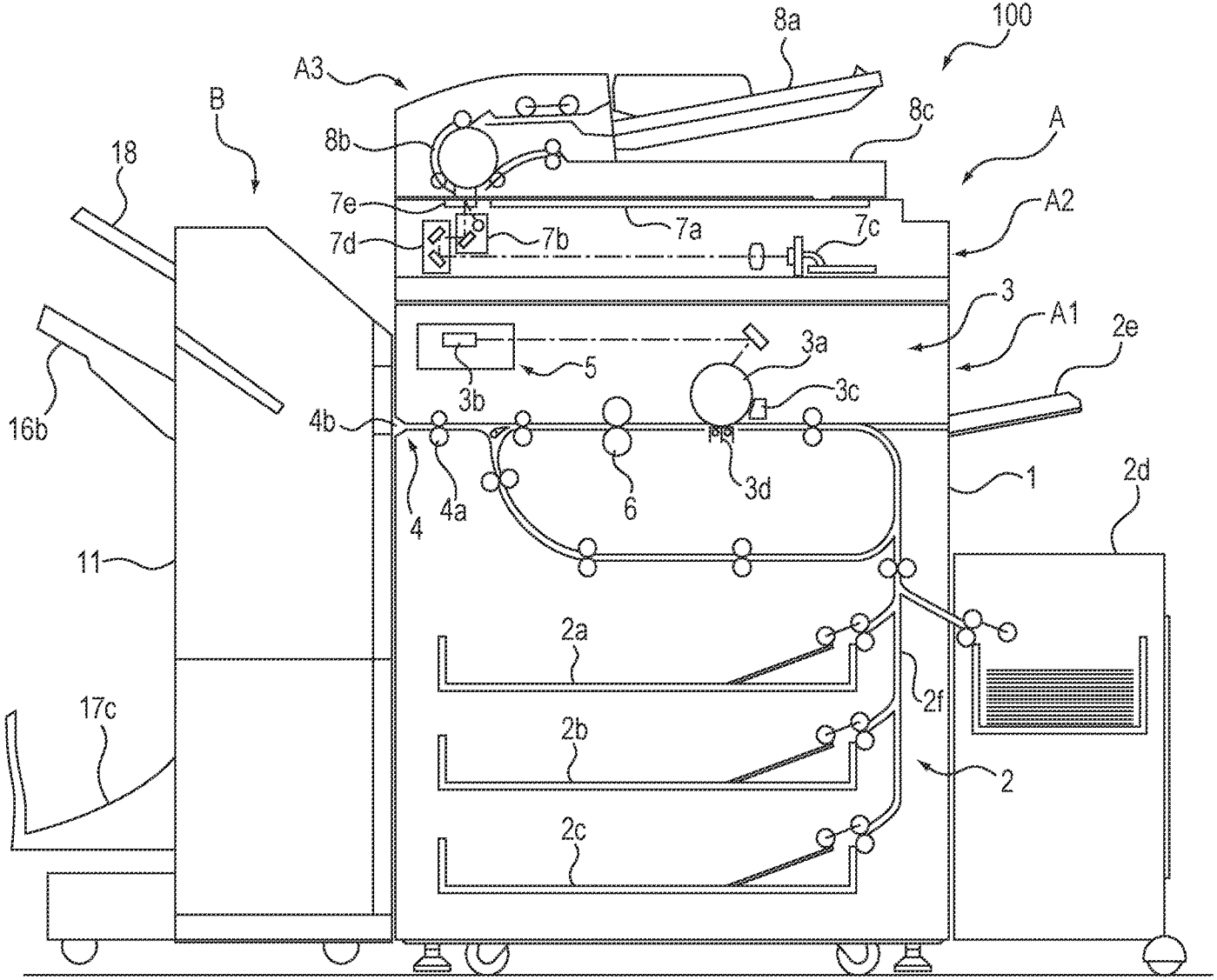
FIG. 1 is an explanatory view of the entire configuration of an image forming system.

Hereinafter, a sheet processing apparatus according to a preferred embodiment of the present invention and an image forming system having the same will be described with reference to the drawings. FIG. 1 schematically illustrates the entire configuration of an image forming system having a sheet processing apparatus according to the embodiment of the present invention. As illustrated in FIG. 1, an image forming system 100 includes an image forming apparatus A and a sheet processing apparatus B installed together therewith.

<Entire Configuration of Image Forming Apparatus>

The image forming apparatus A includes an image forming unit A1, a scanner unit A2, and a feeder unit A3. The image forming unit A1 includes, inside a housing 1, a feed part 2, an image forming part 3, a discharge part 4, and a data processing part 5.

The feed part 2 has a plurality of cassette mechanisms 2*a*, 2*b*, and 2*c* for storing image forming sheets of different sizes and delivers sheets of a size designated from a not-shown main body control part to a sheet feeding path 2*f*. The cassette mechanisms 2*a*, 2*b*, and 2*c* are each configured to be detachable from the feed part 2 and each incorporate a separating mechanism for separating sheets therein one by one and a feed mechanism for delivering sheets. The sheet feeding path 2*f* has a conveying roller for conveying the sheets fed from the cassette mechanisms 2*a*, 2*b*, and 2*c* to the downstream side and has, at its end, a registration roller pair for aligning the sheet leading ends.

The sheet feeding path 2*f* is connected with a large capacity cassette 2*d* and a manual feed tray 2*e*. The large capacity cassette 2*d* is constituted by an option unit for storing sheets of a size to be consumed in a large amount. The manual feed tray 2*e* is configured to feed thick sheets which are difficult to separate upon feeding and special sheets such as coated sheets and film sheets.

The image forming part 3 uses an electrophotographic system in the present embodiment and has a rotating photosensitive drum 3*a* and an emitter 3*b* for emitting optical beam, a developing unit 3*c*, and a cleaner (not shown) which are disposed around the photosensitive drum 3*a*. The illustrated image forming part 3 is a monochrome printing mechanism and configured to irradiate the photosensitive drum 3*a* whose circumferential surface is uniformly charged with light corresponding to an image signal using the emitter 3*b* to optically form a latent image and to attach toner ink to the latent image using the developing unit 3*c* to thereby form a toner image.

A sheet is fed along the sheet feeding path 2*f* to the image forming part 3 at the timing of image formation on the photosensitive drum 3*a*, and a transfer bias is applied from a transfer charger 3*d* to the sheet to transfer the toner image formed on the photosensitive drum 3*a* onto the sheet. The sheet onto which the toner image has been transferred passes through a fixing unit 6 while being heated and pressurized, with the result that the toner image is fixed onto the sheet. The resultant sheet is then discharged from a discharge port 4*b* by a discharge roller 4*a* and conveyed to the sheet processing apparatus B to be described later.

The scanner unit A2 includes a platen 7*a* on which an image document is placed, a carriage 7*b* reciprocating along the platen 7*a*, a photoelectric conversion unit 7*c*, and a optical reduction system 7*d* that guides reflecting light from the document on the platen 7*a* scanned by the carriage 7*b* to the photoelectric conversion unit 7*c*. The photoelectric conversion unit 7*c* photoelectric-converts an optical output from the optical reduction system 7*d* into image data and outputs the image data to the image forming part 3 as an electrical signal.

The scanner unit A2 further includes a platen 7*e* so as to read the sheet fed from the feeder unit A3. The feeder unit A3 includes a feed tray 8*a* on which document sheets are to be stacked, a sheet feeding path 8*b* that guides the document sheet fed from the feed tray 8*a* to the platen 7*e*, and a discharge tray 8*c* that stores the document sheet that has passed the platen 7*e*. The document sheet from the feed tray 8*a* is read by the carriage 7*b* and optical reduction system 7*d* when passing the platen 7*e*.

<Entire Configuration of Sheet Processing Apparatus>

The following describes the entire configuration of the sheet processing apparatus B that applies post-processing to a sheet fed from the image forming apparatus A.

Figure 2:
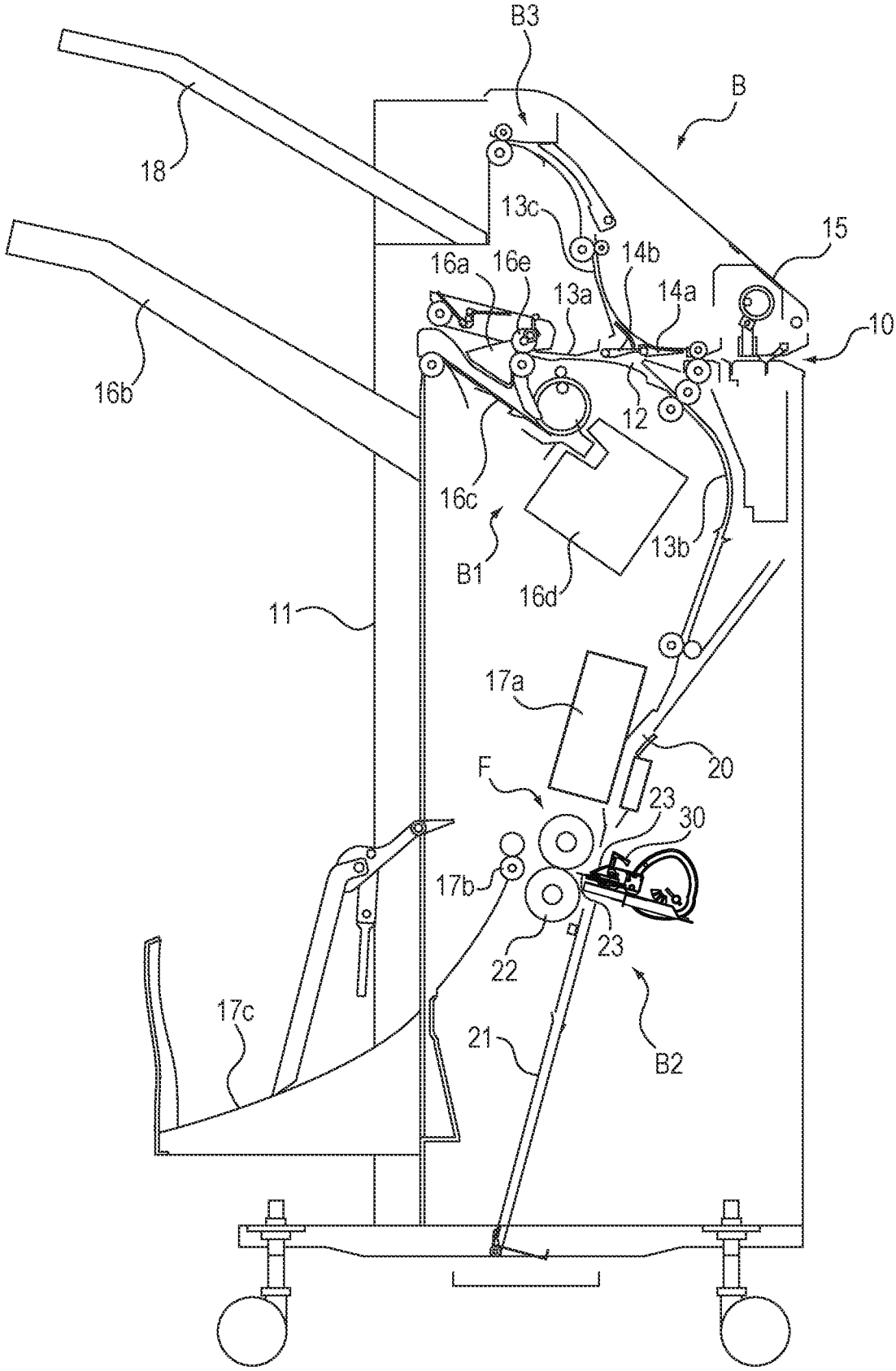
FIG. 2 is an explanatory view of the entire configuration of a sheet processing apparatus in the image forming system.

FIG. 2 is an explanatory view illustrating the configuration of the sheet processing apparatus B according to the present embodiment. The sheet processing apparatus B has a housing 11 provided with a carry-in port 10 for introducing a sheet from the image forming apparatus A. The housing 11 is positioned with respect to the housing 1 of the image forming apparatus A such that the carry-in port 10 communicates with the discharge port 4*b* of the image forming apparatus A.

The sheet processing apparatus B has a sheet carry-in path 12 along which the sheet introduced from the carry-in port 10 is conveyed, first to third discharge paths 13*a*, 13*b*, and 13*c* branching from the sheet carry-in path 12, and first and second path switch units 14*a* and 14*b*. The first and second path switch units 14*a* and 14*b* are each constituted by a flapper guide that changes the conveying direction of the sheet conveyed along the sheet carry-in path 12.

The first path switch unit 14*a* uses a not-shown drive unit to switch between a mode that guides the sheet from the carry-in port 10 toward the first discharge path 13*a* for conveying the sheet in the lateral direction without changing the direction, a mode that guides the sheet from the carry-in port 10 toward the second discharge path 13*b* for conveying the sheet downward, and a mode that guides the sheet from the carry-in port 10 toward the third discharge path 13*c* for conveying the sheet upward. The first and second discharge paths 13*a* and 13*b* communicate with each other so as to allow the sheet that has once been introduced to the first discharge path 13*a* to be switchback-conveyed to the second discharge path 13*b* with the sheet conveying direction reversed.

The second path switch unit 14*b* is disposed downstream from the first path switch unit 14*a* in the conveying direction of the sheet conveyed along the sheet carry-in path 12. The second path switch unit 14*b* uses the not-shown drive unit to switch between a mode that introduces the sheet that has passed through the first path switch unit 14*a* to the first discharge path 13*a* and a mode that switchback-conveys the sheet that has once been introduced to the first discharge path 13*a* to the second discharge path 13*b*.

The sheet processing apparatus B includes first to third processing parts B1, B2, and B3 which perform different post-processing. Further, the sheet carry-in path 12 is provided with a punch unit 15 that punches a punched hole in the sheet carried therein.

The first processing part B1 is a binding processing part. Specifically, the first processing part B1 accumulates, collates, and binds a plurality of sheets that have been discharged from a discharge port 16*a* at the downstream end of the first discharge path 13*a* in the conveying direction of the sheet conveyed along the sheet carry-in path 12 and then discharges the bound sheet bundle to a stack tray 16*b* provided outside the housing 11. The first processing part B1 has a sheet conveying apparatus 16*c* that conveys a sheet or a sheet bundle and a binding processing unit 16*d* that binds a sheet bundle. The first discharge path 13*a* has, at its downstream end, a discharge roller pair 16*e* for sheet discharge from the discharge port 16*a* and for switchback conveyance from the first discharge path 13*a* to the second discharge path 13*b*.

The second processing part B2 is a folding processing part. Specifically, the second processing part B2 forms a sheet bundle by stacking a plurality of sheets switchback-conveyed from the second discharge path 13*b*, binds the sheet bundle, followed by folding processing. As described later, the second processing part B2 has a folding processing apparatus F that folds the sheet or sheet bundle carried therein and a binding processing unit 17*a* that is disposed immediately upstream from the folding processing apparatus F in the conveying direction of the sheet conveyed toward the second discharge path 13*b* and binds a sheet bundle. The sheet or sheet bundle that has been subjected to folding processing is discharged onto a stack tray 17*c* provided outside the housing 11 by a discharge roller 17*b*.

The third processing part B3 performs jog sorting to sort the sheets fed from the third discharge path 13*c* into a group stacked so as to be offset by a predetermined amount in the sheet width direction perpendicular to the conveying direction and a group stacked without being offset. The jog-sorted sheets are discharged onto a stack tray 18 provided outside the housing 11, and the sheet bundle of the offset group and the sheet bundle of the non-offset group are stacked on the stack tray 18.

Figure 3:
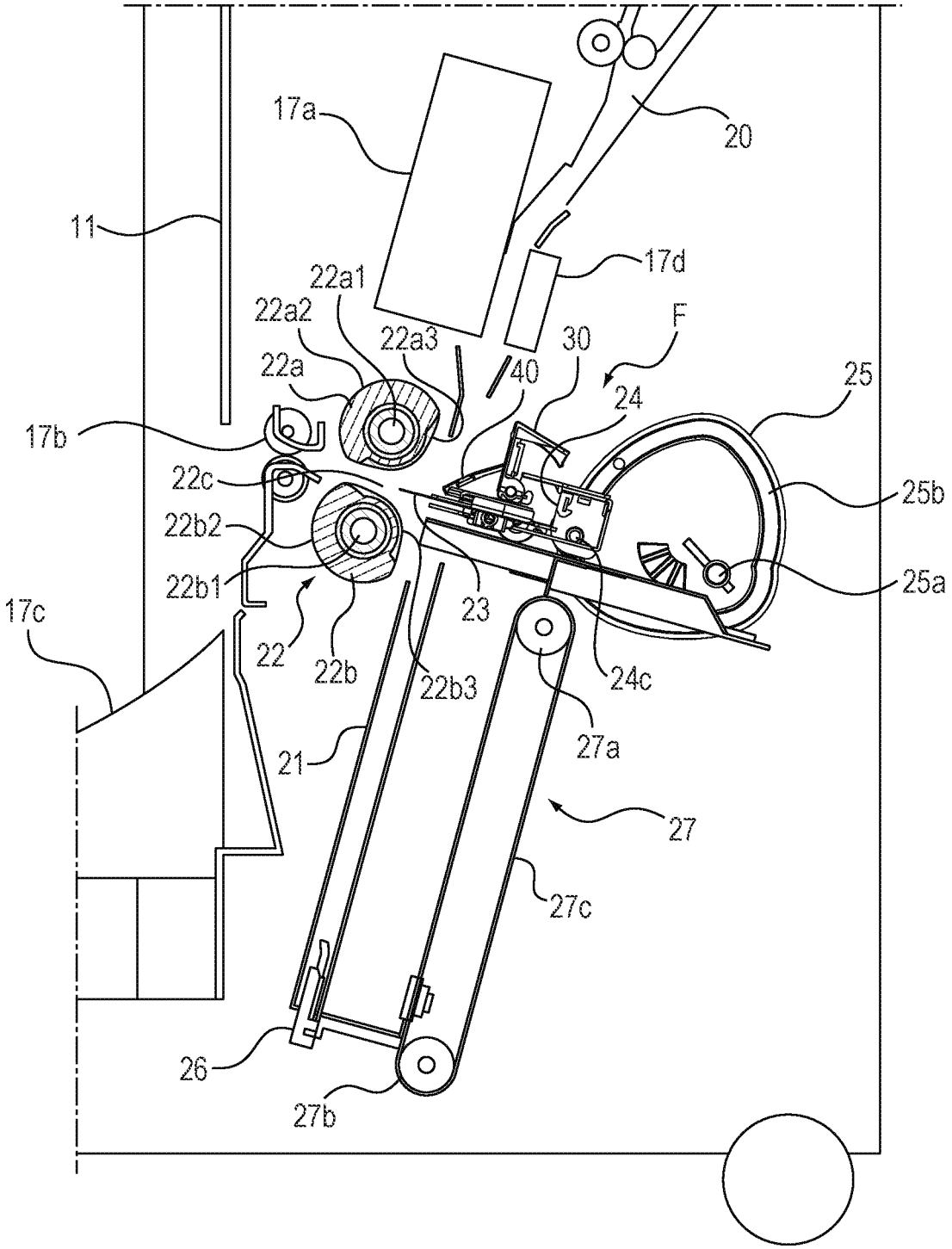
FIG. 3 is a cross-sectional view illustrating a sheet folding processing apparatus of the sheet processing apparatus.

FIG. 3 schematically illustrates the entire configuration of the second processing part B2. As described above, the second processing part B2 has the folding processing apparatus F that folds in two the sheet bundle carried therein from the second discharge path 13*b* and stacked in a collated manner and the binding processing unit 17*a* that binds a sheet bundle before being folded. The illustrated binding processing unit 17*a* is a stapler device that drives a staple needle into a sheet bundle to binds it.

The second discharge path 13*b* is connected with a sheet conveying path 20 so as to carry a sheet in the folding processing apparatus F. A sheet stacking tray 21 constituting a part of the sheet conveying path 20 is provided downstream of the sheet conveying path 20 in the conveying direction of the sheet conveyed from the second discharge path 13*b* to the sheet stacking tray 21. On the sheet stacking tray 21, sheets to be folded are positioned and stacked. The binding processing unit 17*a* and a needle receiving part 17*d* are provided immediately upstream relative to the sheet stacking tray 21 so as to face each other through the sheet conveying path 20.

A folding roller pair 22 as a folding rotor pair is provided on one side of the sheet stacking tray 21 in the sheet thickness direction so as to face one surface of the sheet or sheet bundle stacked on the sheet stacking tray 21. The folding roller pair 22 is composed of folding rollers 22*a* and 22*b* whose roller surfaces are brought into pressure contact with each other, and a nip part 22*c*, which is the pressure contact part therebetween, is disposed facing the sheet stacking tray 21. The folding rollers 22*a* and 22*b* are disposed in juxtaposition respectively at the upstream and downstream sides in the conveying direction of the sheet conveyed to the sheet stacking tray 21 from the upstream side above the sheet stacking tray 21 to the downstream side below the sheet stacking tray 21 so as to be equidistant from the sheet stacking tray 21. The folding rollers 22*a* and 22*b* are each a seamless roller whose surface contacting a sheet is not divided into a plurality of parts in the rotary axis direction. In the present invention, the rotating part functioning as the folding rotor pair is not limited to the folding rollers 22*a* and 22*b*, and may be, for example, a rotating belt. Further, the folding roller pair 22 may have a configuration in which a plurality of folding rollers (rotors) are continuously disposed in series along the axial direction of each of the folding rollers 22*a* and 22*b*.

The folding roller 22*a* (first rotor) has, as illustrated in FIG. 3, a first roller surface (first peripheral surface) 22*a*2 at a position of constant distance (radius) R1 from the rotary axis of the rotary shaft 22*a*1 and a second roller surface (second peripheral surface) 22*a*3 at a position of distance from the rotary axis of the rotary shaft 22*a*1 being smaller than the radius R1 of the first roller surface 22*a*2. The folding roller 22*b* (second rotor) has a first roller surface 22*b*2 at a position of constant distance (radius) R1 from the rotary axis of the rotary shaft 22*b*1 and a second roller surface 22*b*3 at a position of distance from the rotary axis of the rotary shaft 22*b*1 being smaller than the radius R1 of the first roller surface 22*b*2. The first roller surfaces 22*a*2 and 22*b*2 are each made of a rubber material or the like having a comparatively high friction coefficient as in the roller surface of a roller used for typical sheet conveyance and are configured to be brought into pressure contact with each other to form the nip part 22*c*, while the second roller surfaces 22*a*3 and 22*b*3 are each made of a plastic resin material or the like having a friction coefficient lower than that of the material of each of the first roller surfaces 22*a*2 and 22*b*2.

Figure 20:
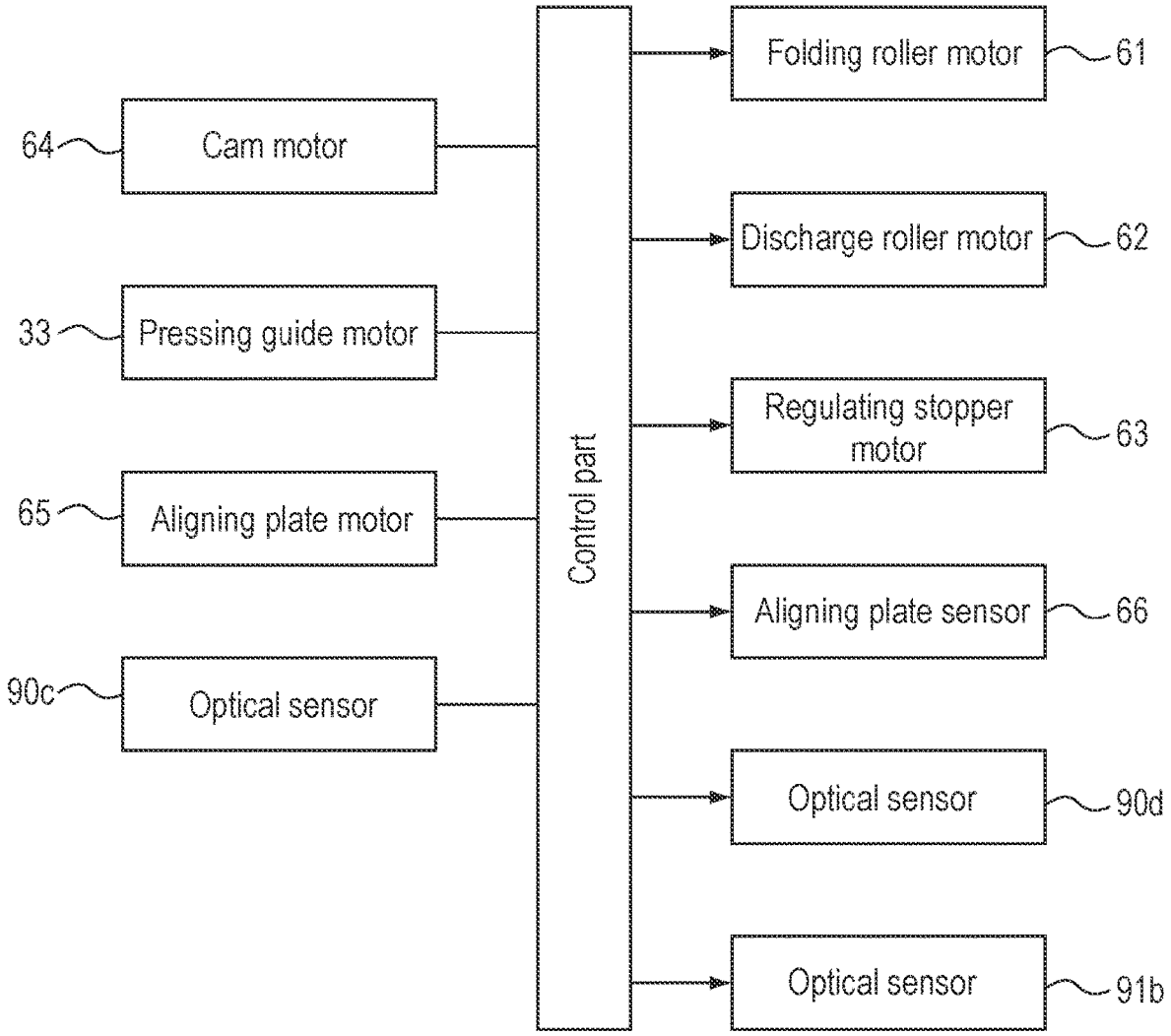
FIG. 20 is a control block diagram illustrating the folding operation in the sheet folding processing apparatus.

The rotary shafts 22*a*1 and 22*b*1 of the folding rollers 22*a* and 22*b* are driven into rotation by a common folding roller motor 61 (FIG. 20). Thus, the folding rollers 22*a* and 22*b* are rotated in sync with each other, allowing the rotation positions of the first folding roller surfaces 22*a*2 and 22*b*2 and the rotation positions of the second roller surfaces 22*a*3 and 22*b*3 to be always sync with each other.

A folding blade 23 serving as a thrust member is disposed on the side opposite to the folding roller pair 22 with respect to the sheet stacking tray 21. The folding blade 23 is supported by a blade carrier 24 with its distal end facing the nip part 22*c* of the folding roller pair 22. The blade carrier 24 can travel, by means of a cam member 25 to be described later, to a direction traversing the sheet stacking tray 21 at substantially right angles, i.e., a direction intersecting the conveying direction of the sheet conveyed from the second discharge path 13*b* to the sheet stacking tray 21.

The cam member 25 is composed of a pair of eccentric cams (only one eccentric cam is illustrated in FIG. 3), which are mirror-symmetric with each other and provided on both sides of the blade carrier 24 so as to face each other in the front-rear direction in FIG. 3, i.e., the axial direction of the folding roller. The cam member 25 is rotated by a drive unit such as a drive motor about a rotary shaft 25*a* provided at the eccentric position. The cam member 25 has a cam groove 25*b* along the outer peripheral edge thereof.

The blade carrier 24 has, as a cam follower, a cam pin 24*c* freely slidably fitted in the cam groove 25*b*.

When the cam member 25 is rotated by a drive motor, the blade carrier 24 can reciprocally travel in a direction approaching or separating from the sheet stacking tray 21. This allows, as illustrated in FIG. 3, the folding blade 23 to linearly freely move forward and backward between a position where the distal end of the folding blade 23 does not enter the sheet conveying path formed by the sheet stacking tray 21 and a maximum protruding position where the distal end of the folding blade 23 is nipped at the nip part 22*c* of the folding roller pair 22 along a thrust path connecting both the above positions. The position where the distal end of the folding blade 23 does not enter the sheet conveying path 20 formed by the sheet stacking tray 21 is a home position of the folding blade 23, and the folding blade 23 is returned to the home position at, for example, power-on of the sheet processing apparatus B by initialization control to be described later.

A regulating stopper 26 is disposed at the lower end of the sheet stacking tray 21. The regulating stopper 26 is configured to make the leading end of the conveyed sheet in the conveying direction abut thereagainst for regulation. The regulating stopper 26 can be elevated and lowered along the sheet stacking tray 21 by a sheet elevating/lowering mechanism 27.

The sheet elevating/lowering mechanism 27 according to the present embodiment is disposed on the back side of (below) the sheet stacking tray 21 and below the blade carrier 24 when the folding blade 23 is at its home position. The sheet elevating/lowering mechanism 27 includes a pair of pulleys 27*a* and 27*b* disposed respectively near the upper and lower ends of the sheet stacking tray 21 along the sheet stacking tray 21 and a transmission belt 27*c* wound around the pulleys to constitute a conveyer belt mechanism. The regulating stopper 26 is fixed onto the transmission belt 27*c*. Rotating the drive side pulley 27*a* or 27*b* by means of a regulating stopper motor 63 (FIG. 20) allows the regulating stopper 26 to be elevated and lowered between the lower end position illustrated in FIG. 3 and a predetermined height position to thereby move a sheet or a sheet bundle along the sheet stacking tray 21.

Figure 4:
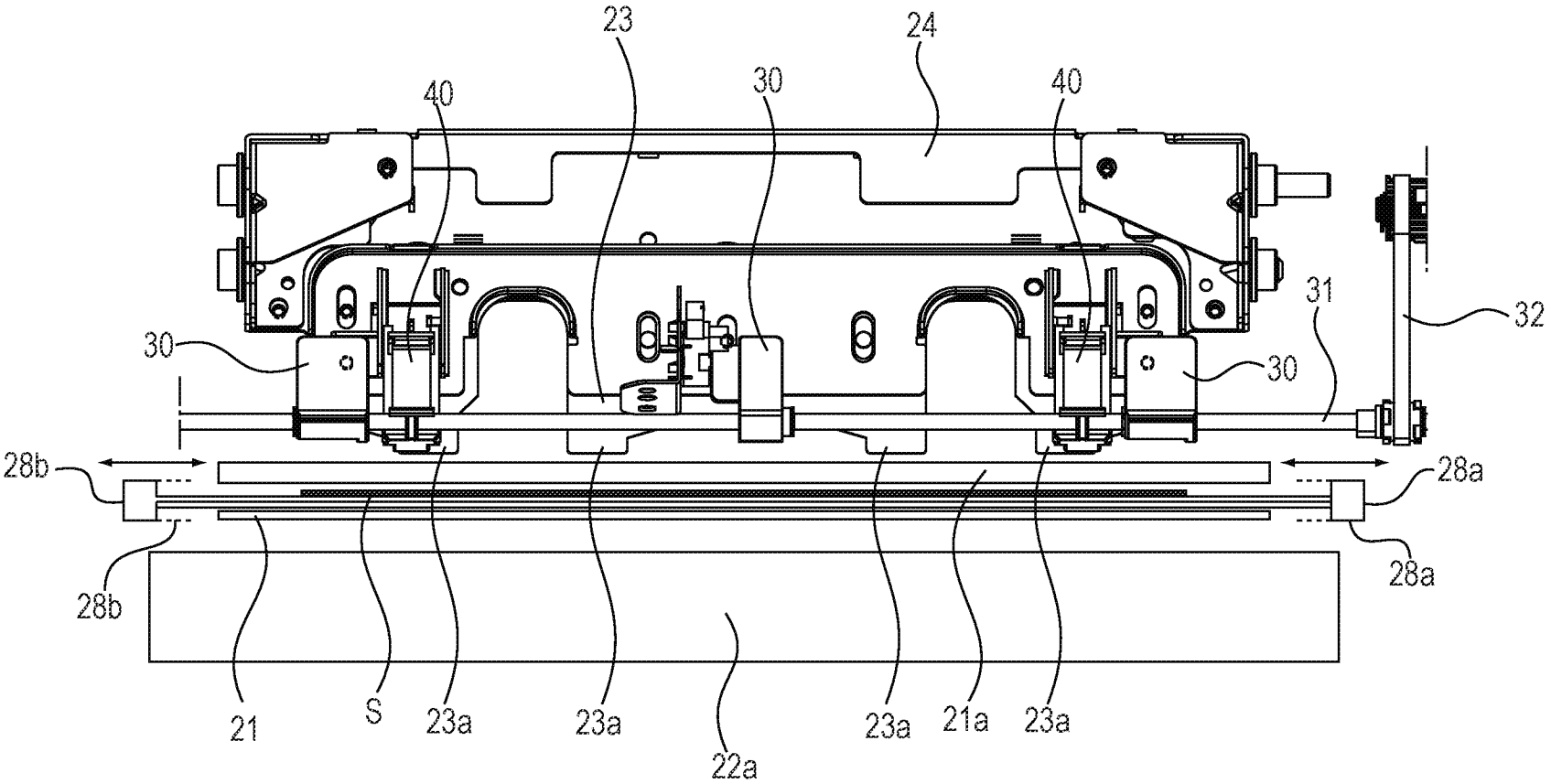
FIG. 4 is a plan view illustrating the sheet folding processing apparatus.

The folding processing apparatus F according to the present embodiment further has a sheet side aligning mechanism for aligning the side edge of the sheet to be carried into the sheet stacking tray 21. As illustrated in FIG. 4, the sheet side aligning mechanism has a pair of sheet aligning plates 28*a* and 28*b* symmetrically disposed on both sides of the sheet stacking tray 21 in the sheet width direction (direction perpendicular to the sheet conveying direction). FIG. 4 is a schematic plan view as viewed from above the folding processing apparatus F.

The aligning plates 28*a* and 28*b* are configured to relatively approach and separate from each other in the sheet width direction by normally and reversely rotating an aligning plate motor 65 (FIG. 20). The aligning plates 28*a* and 28*b* are moved with respect to the sheet that has been conveyed to the sheet stacking tray 21 and has abutted, at its leading end, against the regulating stopper 26, to abut against both end positions of the sheet, whereby the position of the sheet in the sheet width direction is aligned.

Further, an aligning plate sensor 66 (FIG. 20) such as an optical sensor is provided around each of the aligning plates 28*a* and 28*b*. The aligning plate sensor 66 detects that each of the aligning plates 28*a* and 28*b* is located at a home position which is set outside the maximum sheet width in the sheet width direction. The aligning plates 28*a* and 28*b* are returned to the home position at, for example, power-on of the sheet processing apparatus B by initialization control to be described later.

<Inward Threefold Processing>

The sheet processing apparatus B according to the present embodiment can perform inward threefold processing for a sheet conveyed to the sheet stacking tray 21 serving as a sheet conveying path using the folding processing apparatus F. The inward threefold processing includes first folding processing of folding a sheet in two and second folding processing of folding the sheet at a position different from that in the first folding processing. Specifically, one end portion of the sheet folded in the first folding processing is folded inside the sheet folded in the second folding processing. The following schematically describes the operation of the inward threefold processing with reference to FIGS. 5A to 11B. FIGS. 5A to 11B are schematic cross-sectional views illustrating the operation of each component along the flow of a sheet S in the inward threefold processing.

The sheet stacking tray 21 according to the present embodiment is inclined with respect to the vertical direction. The sheet S is conveyed so as to fall, with a sheet leading end S1 at the bottom and a sheet rear end S2 at the top, while the surface thereof on one side guided by a guide surface 21*a* constituting the sheet stacking tray 21 and is stopped when the sheet leading end S1 abuts against the regulating stopper 26 (FIG. 5A). At this time, the regulating stopper 26 is disposed at a position where the first folding position of the sheet S whose leading end S1 abuts thereagainst is aligned with the folding blade 23. The folding blade 23 is disposed at a position where it thrusts the sheet S from the side of the guide surface 21*a* of the sheet stacking tray 21 toward the folding roller pair 22. In other words, the guide surface 21*a* of the sheet stacking tray 21 and folding roller pair 22 are disposed so as to correspond in position to each other through the sheet S.

Figure 5B:
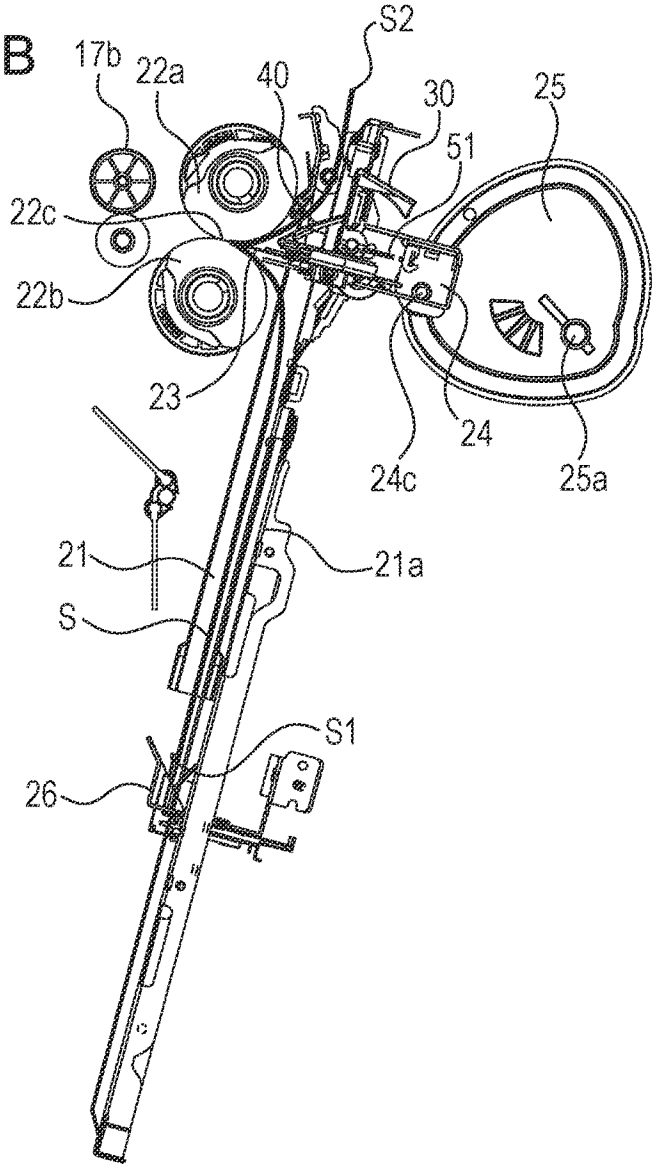
FIGS. 5A and 5B are cross-sectional views explaining a sheet inward threefold operation.
Figure 5A:
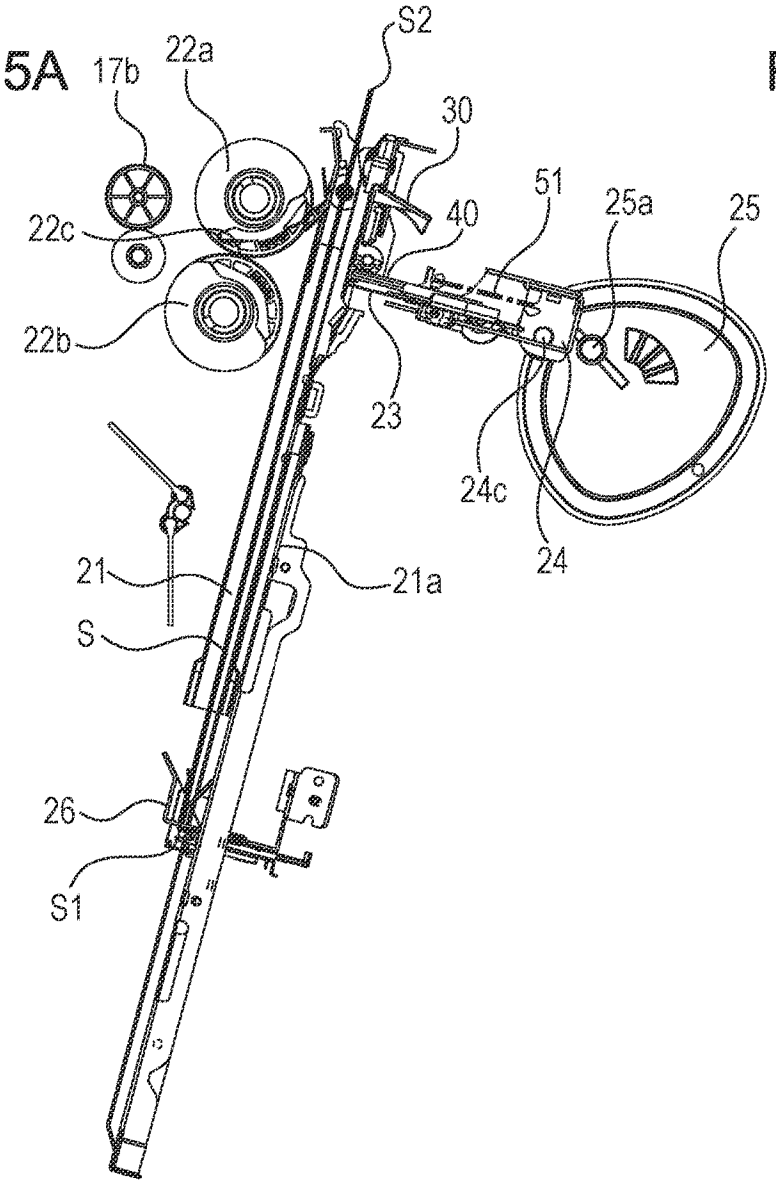
Figure 6B:
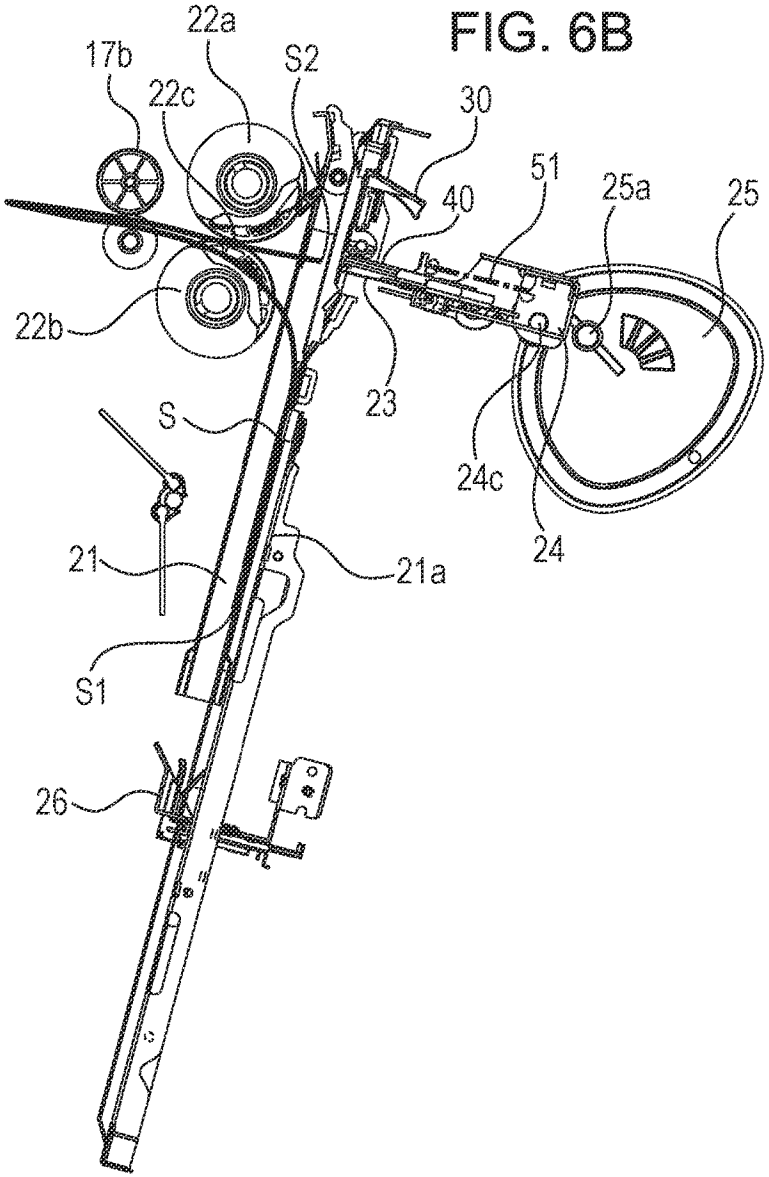
FIGS. 6A and 6B are cross-sectional views explaining the sheet inward threefold operation.
Figure 6A:
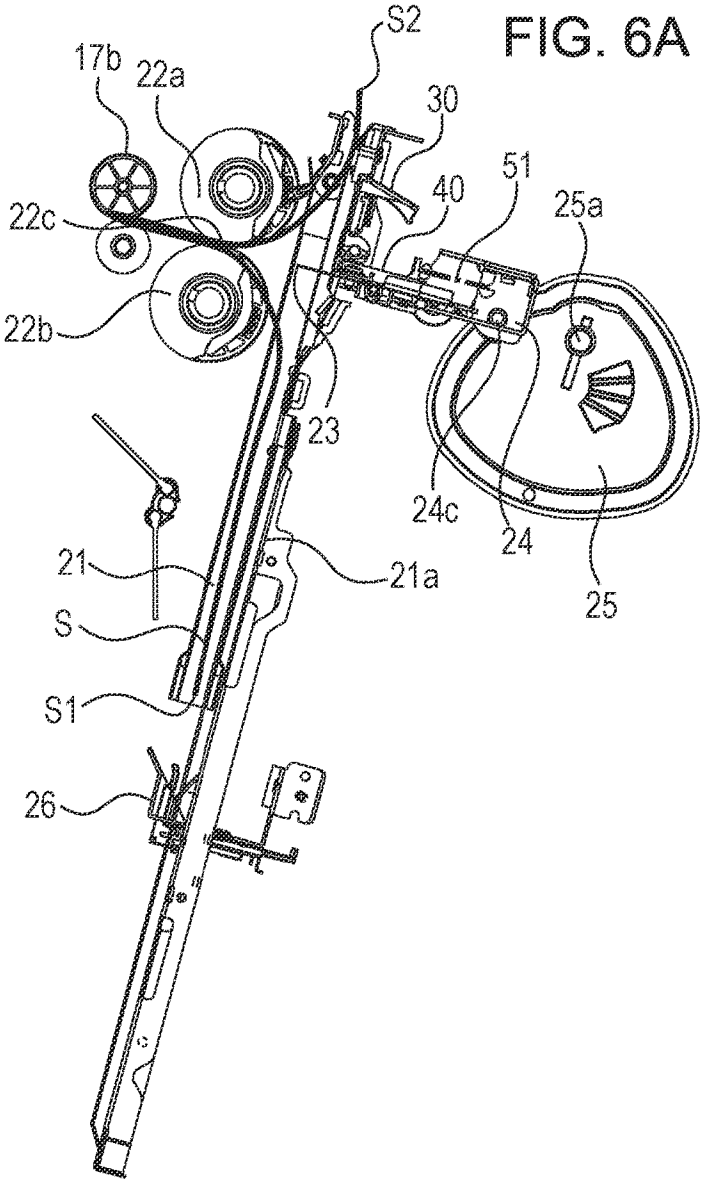

In this state, after the sheet position in the sheet width direction is aligned using the above-described aligning plates 28*a* and 28*b*, the folding blade 23 is operated to fold the sheet S in two and thrust the folding position to the nip part 22*c* of the folding roller pair 22 (FIG. 5B). In sync with the thrust operation of the folding blade 23, the folding roller pair 22 and discharge roller 17*b* are normally driven to convey the sheet S in a direction (first direction) toward the folding roller pair 22 and discharge roller 17*b*. Thus, the sheet S is pressed at the nip part 22*c* of the folding roller pair 22, whereby the first folding processing is performed (FIG. 6A).

Figure 7B:
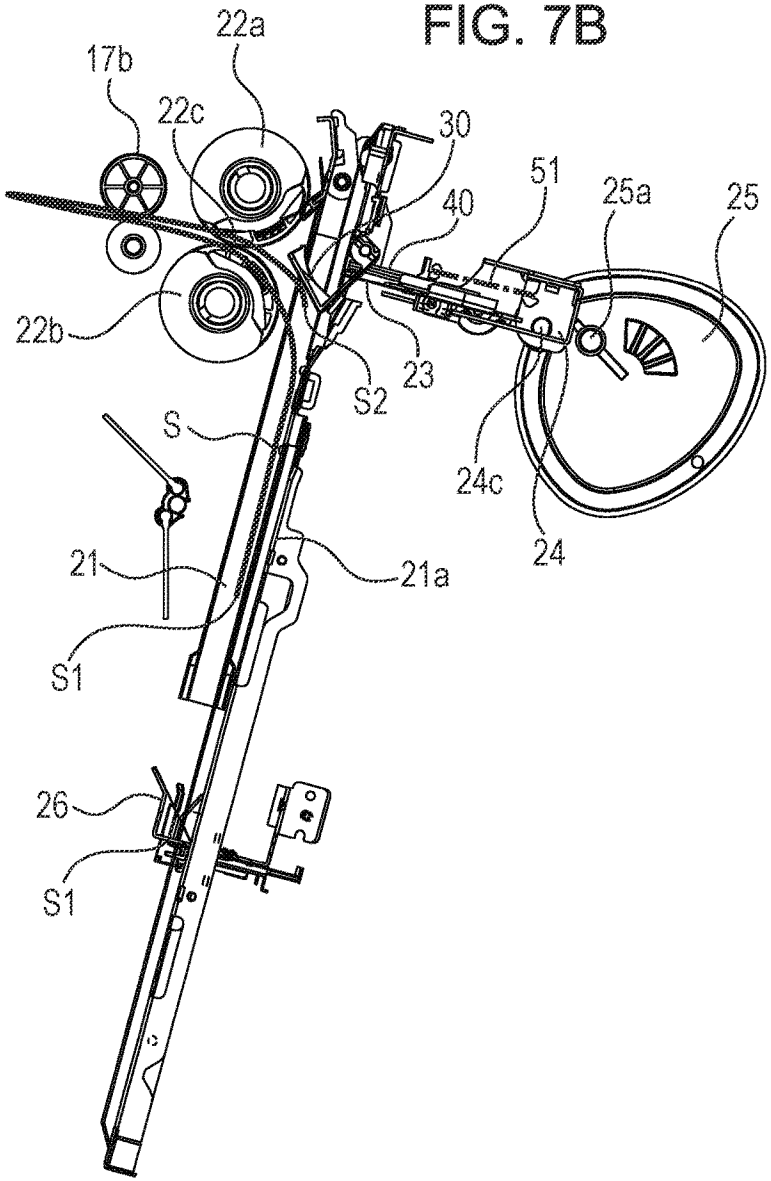
FIGS. 7A and 7B are cross-sectional views explaining the sheet inward threefold operation.
Figure 7A:
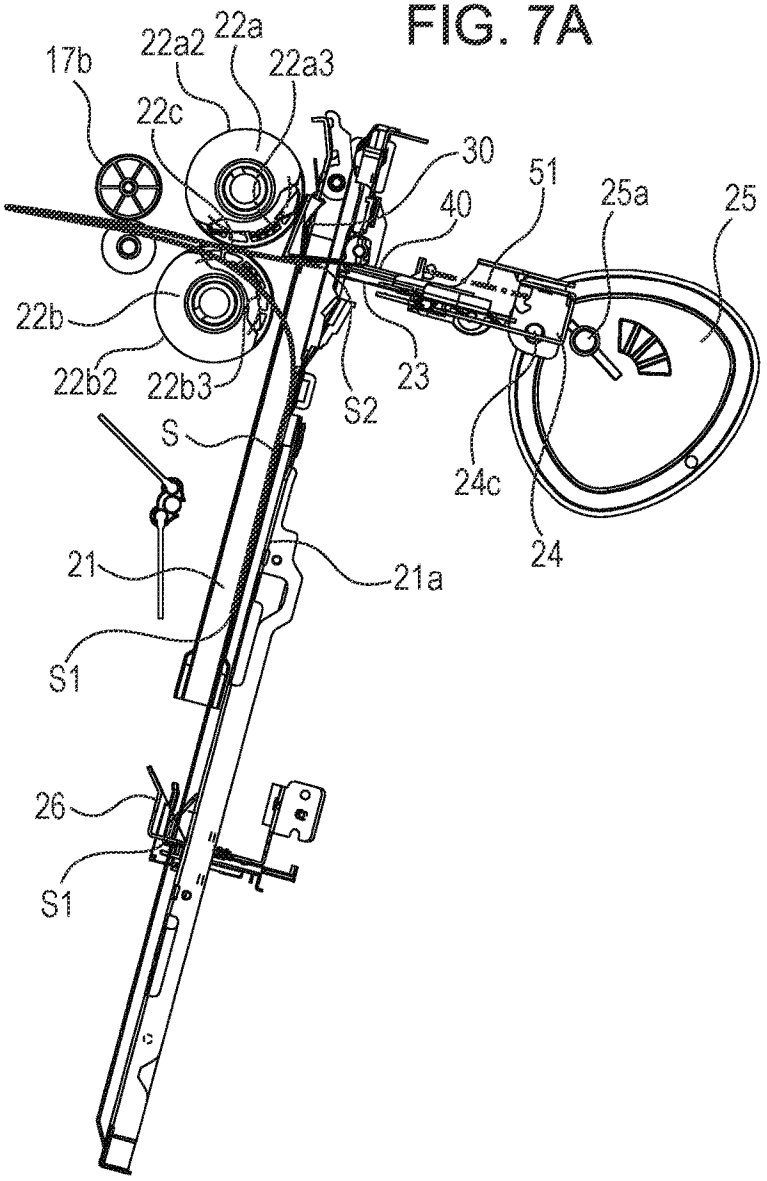
Figure 8B:
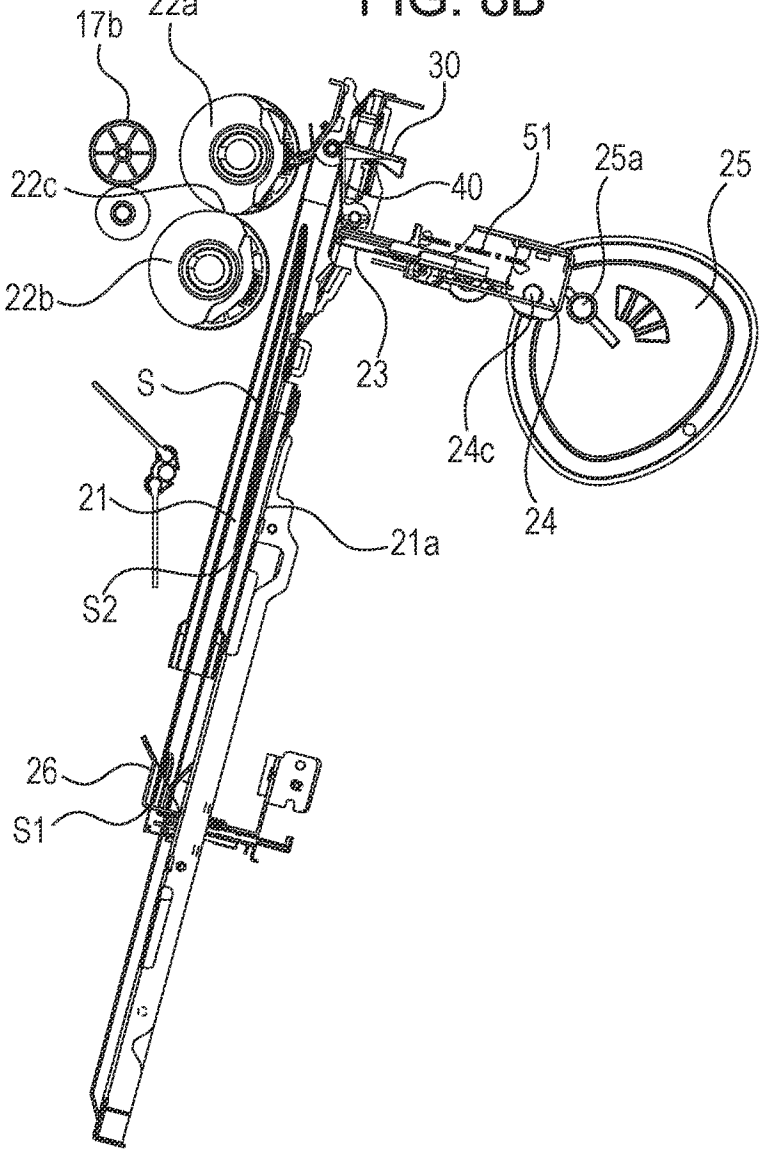
FIGS. 8A and 8B are cross-sectional views explaining the sheet inward threefold operation.
Figure 8A:
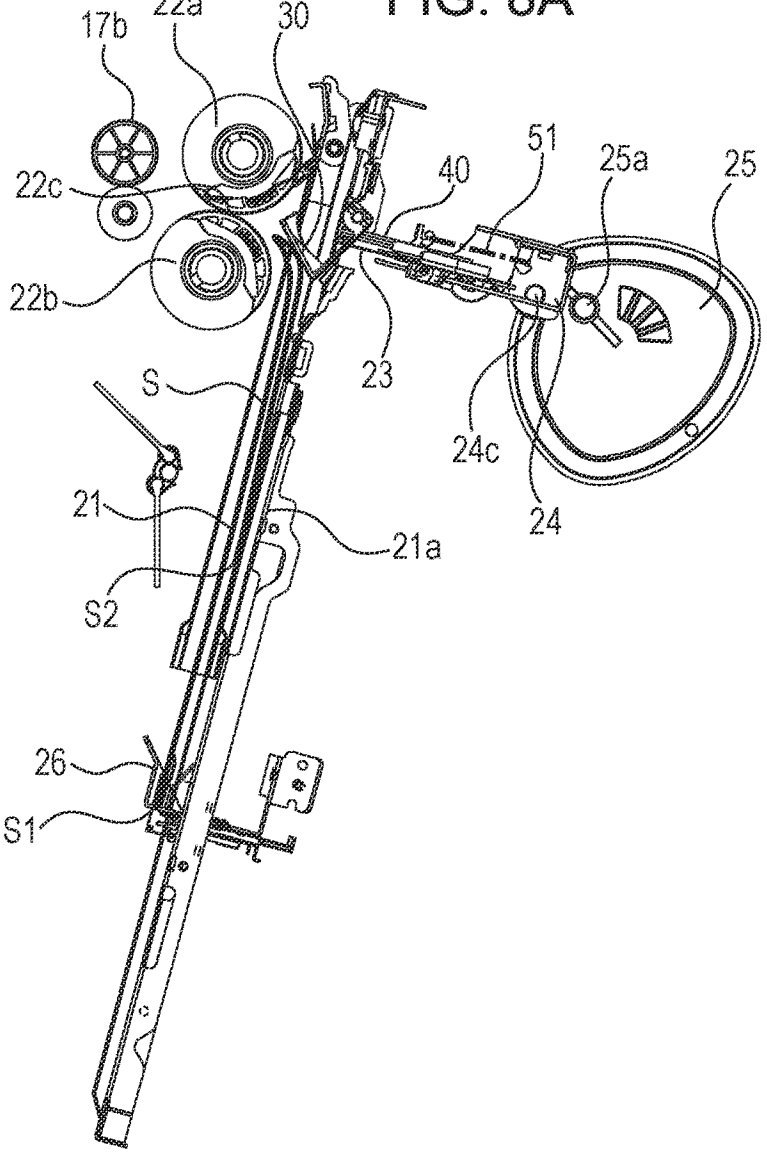

Then, for the second folding processing, sheet conveyance is stopped at the time point when the sheet rear end S2 of the sheet that has been subjected to the first folding processing reaches a predetermined position (FIG. 6B), and the folding roller pair 22 and discharge roller 17*b* are reversely rotated to switchback-convey the sheet S in a direction (second direction) opposite to the above first direction. The sheet rear end S2 becomes an end portion (hereinafter, referred to as "folded end portion") folded inside the sheet S that has been subjected to the second folding processing. When the sheet S is switchback-conveyed, the folded end portion S2 of the sheet S is pressed downward (in a direction toward the sheet stacking tray 21 where the sheet leading end S1 exists) by an L-shaped pressing guide member 30 (FIG. 7A). At the same time, the pressing guide member 30 guides the sheet S being conveyed again in a direction where the regulating stopper 26 of the sheet stacking tray 21 is disposed (FIG. 7B). The configuration and operation of the pressing guide member 30 will be described in detail later.

Figure 9B:
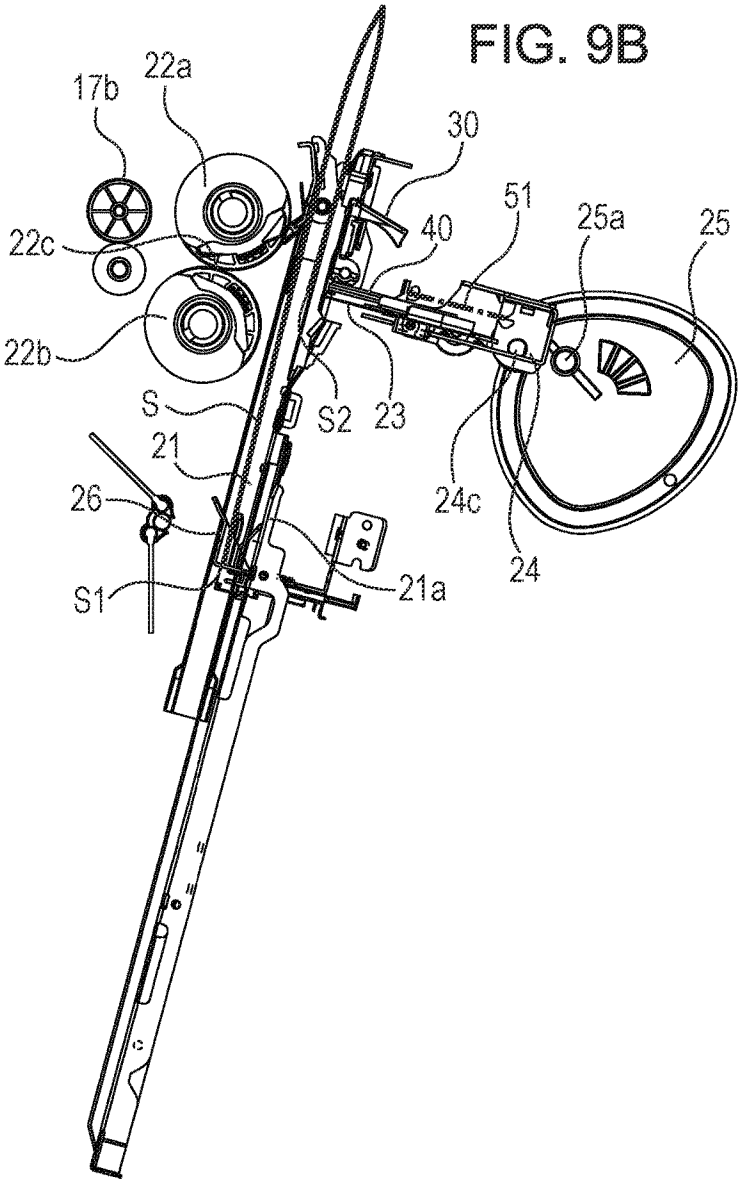
FIGS. 9A and 9B are cross-sectional views explaining the sheet inward threefold operation.
Figure 9A:
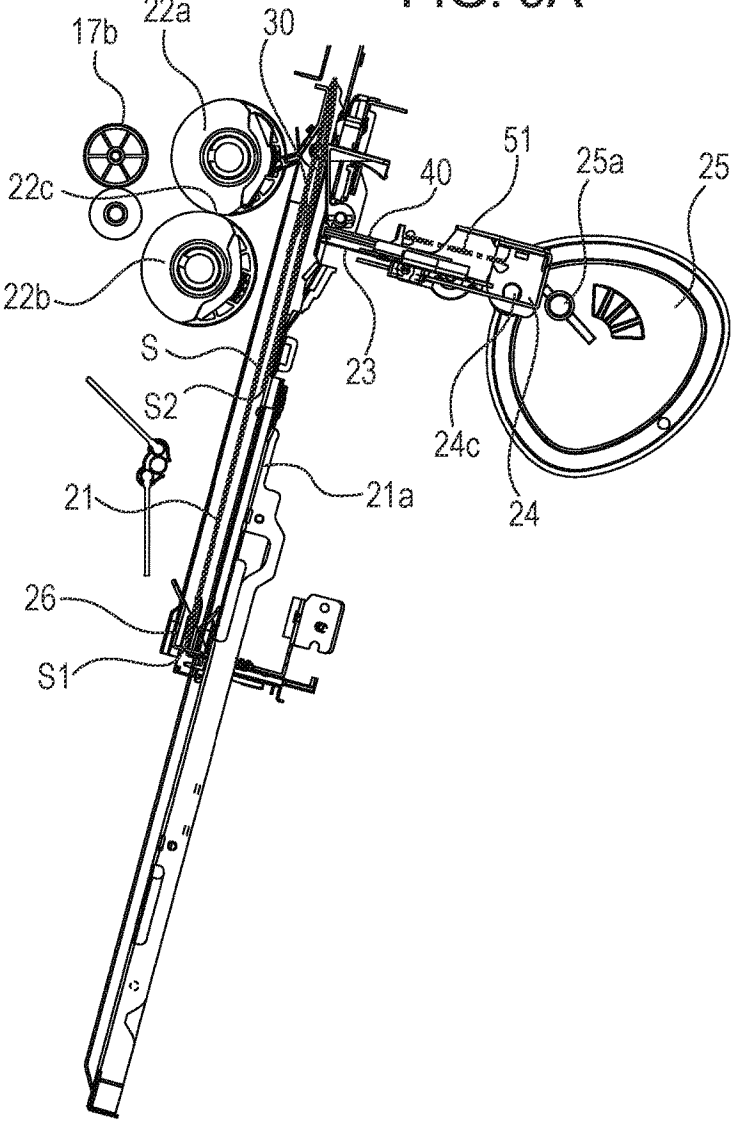

When the leading end of the sheet S reaches the regulating stopper 26 that has already been moved to a sheet receiving position by the switchback conveyance (FIG. 8A), the pressing guide member 30 is moved to a position where it slightly protrudes from the guide surface 21*a* of the sheet stacking tray 21 toward the sheet conveying path 20 (FIG. 8B), and the regulating stopper 26 is moved to move the second folding position to a position aligned with the folding blade 23 (FIG. 9A). Then, after completion of the movement of the regulating stopper 26, the pressing guide member 30 is moved to a retracting position (FIG. 9B).

Figure 10B:
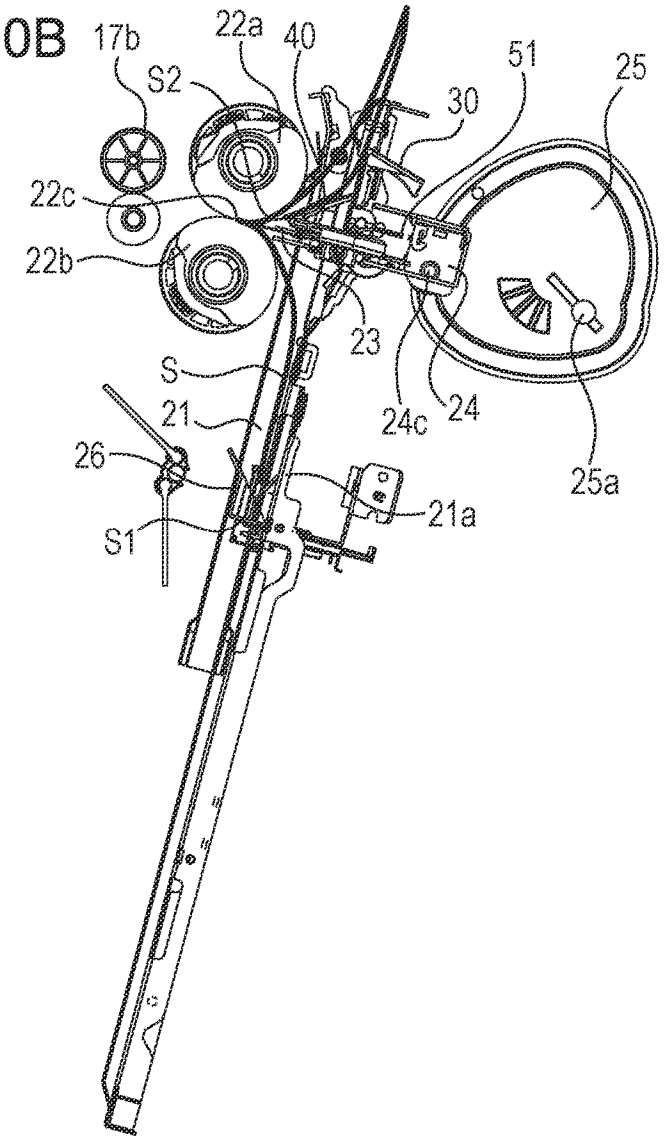
FIGS. 10A and 10B are cross-sectional views explaining the sheet inward threefold operation.
Figure 10A:
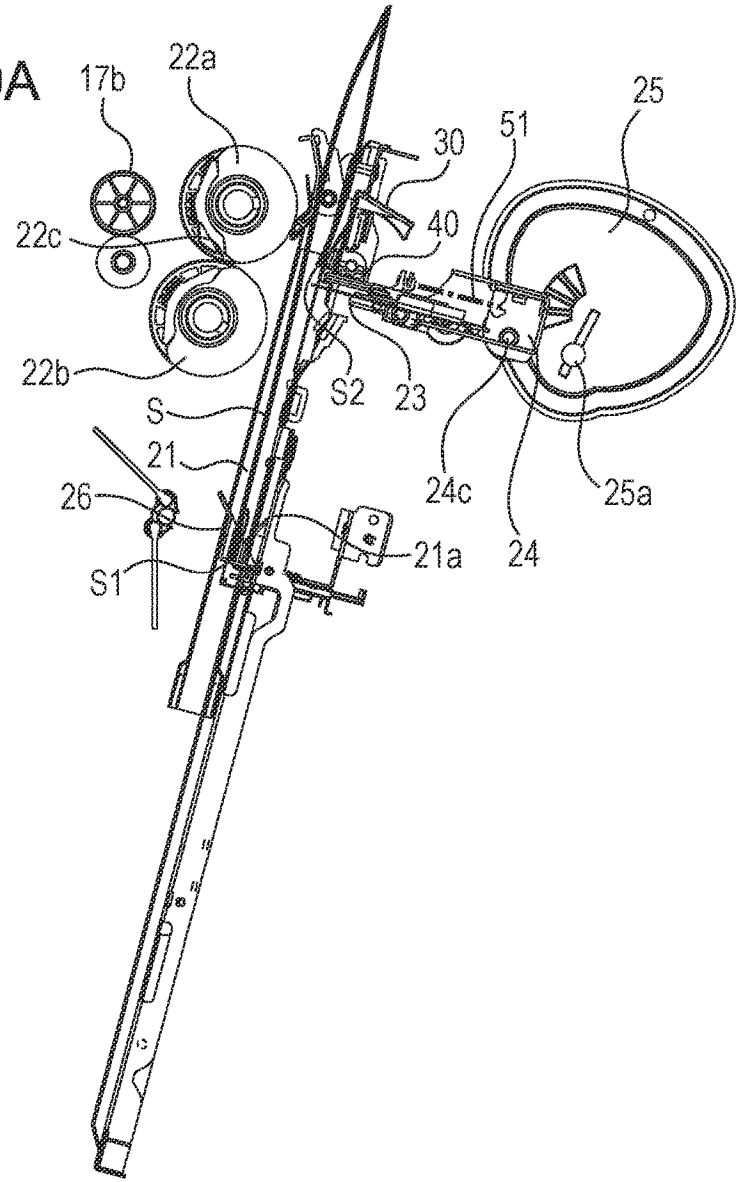

Then, the folding blade 23 is operated again to thrust the sheet S to the nip part 22*c* of the folding roller pair 22 (FIG. 10A). At this time, a blade guide member 40 as a thrust guide member disposed above the folding blade 23 protrudes, whereby the folded end portion S2 of the sheet S is guided so as to be pushed to the nip part 22*c* (FIG. 10B). The configuration and operation of the blade guide member 40 will be described in detail later.

Figure 11B:
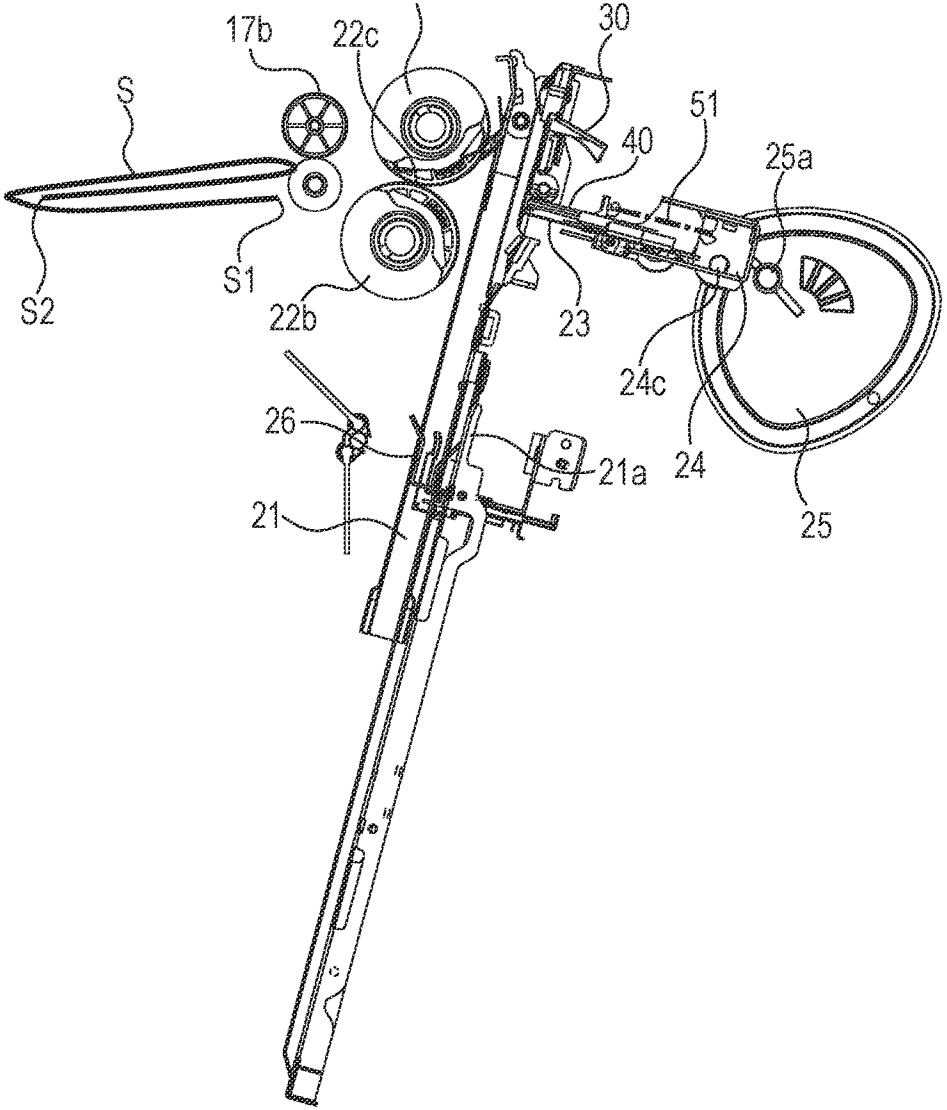
FIGS. 11A and 11B are cross-sectional views explaining the sheet inward threefold operation.
Figure 11A:
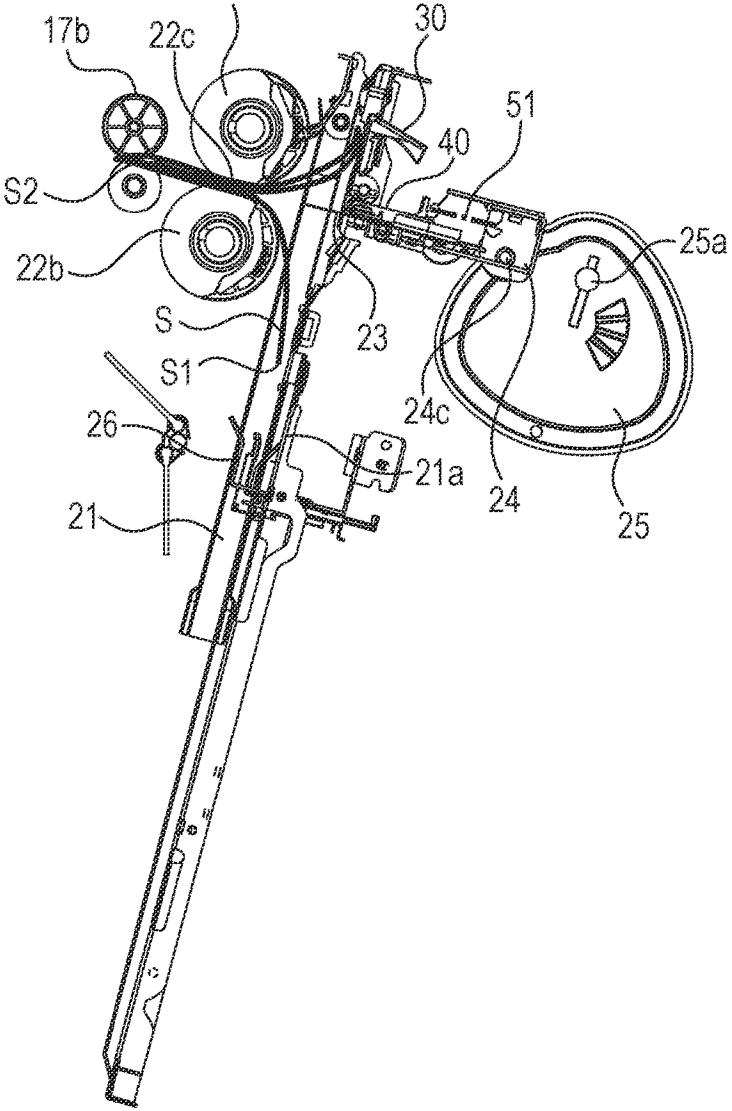

The sheet S fed to the folding roller pair 22 by the thrust of the folding blade 23 passes through the nip part 22*c* to be subjected to the second folding processing (FIG. 11A), and the sheet S that has been folded inward in three is discharged by the discharge roller 17*b* (FIG. 11B).

<Pressing Guide Member>

Figure 12:
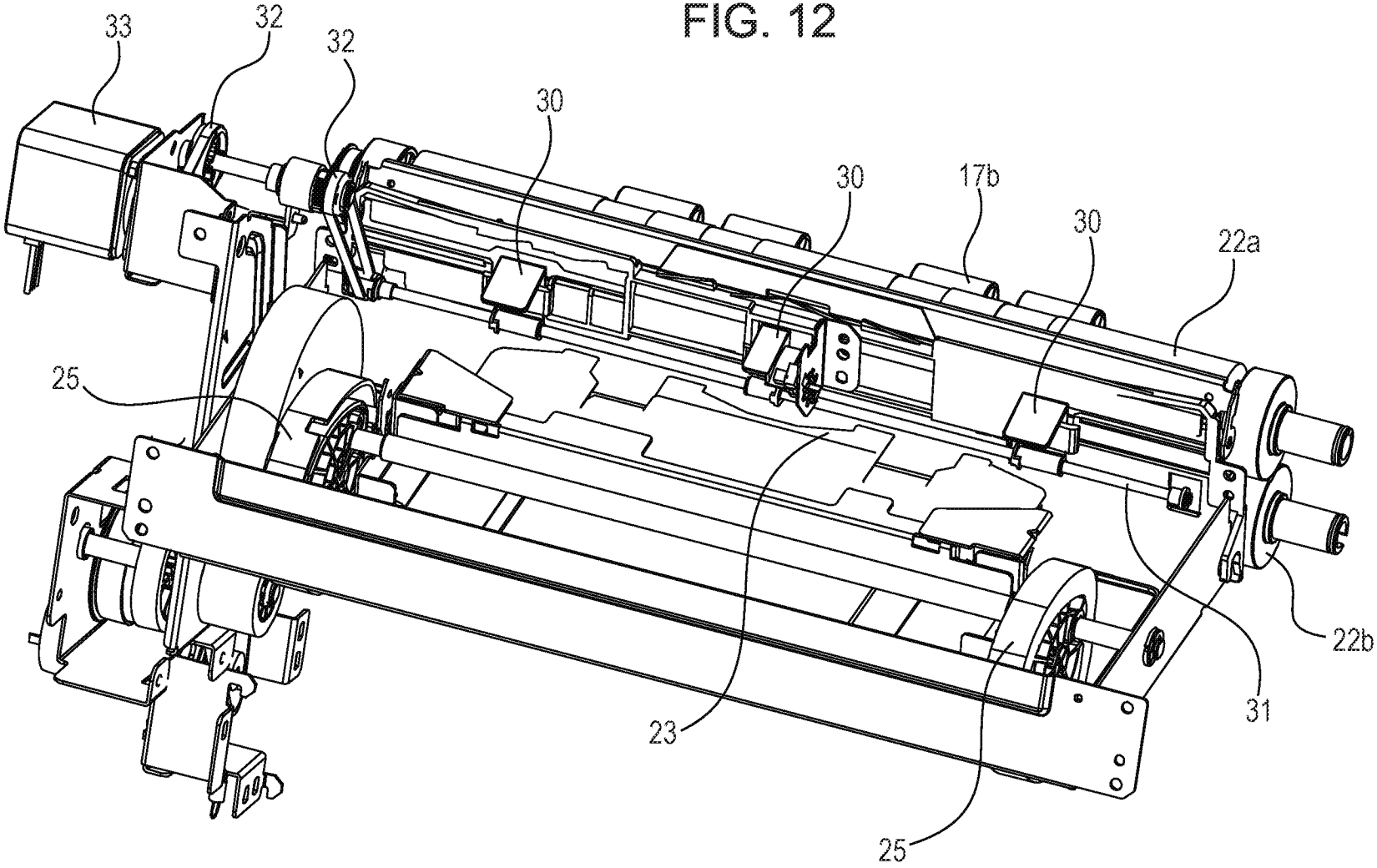
FIG. 12 is a perspective view illustrating a part of the sheet folding processing apparatus.
Figure 13:
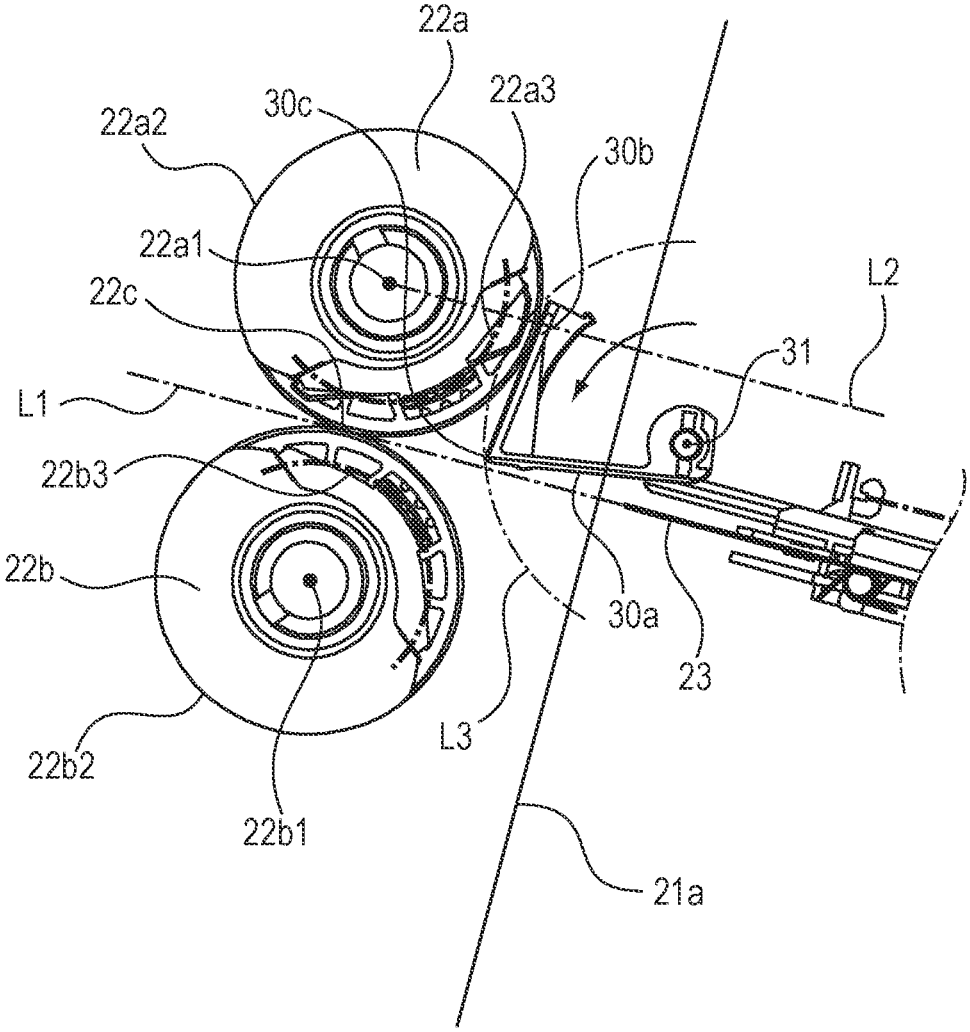
FIG. 13 is an explanatory view depicting the arrangement of a folding roller pair, a folding blade, and a pressing guide member.
Figure 14A:
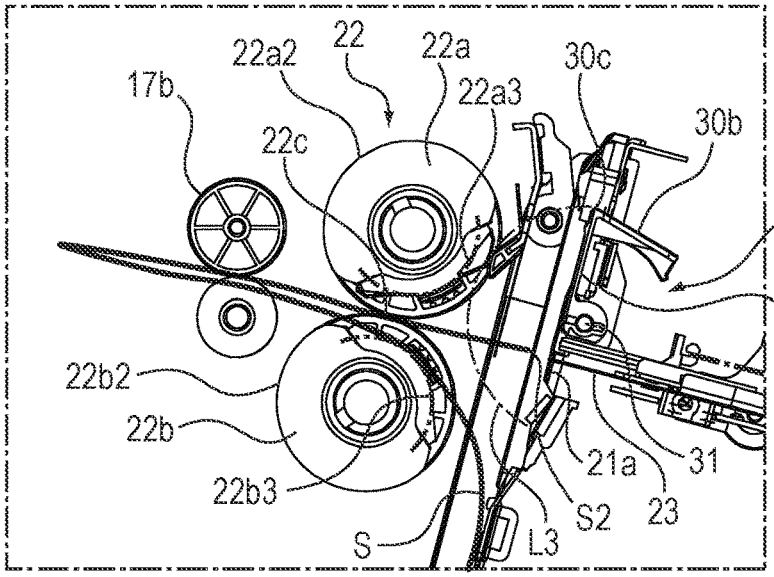
FIGS. 14A to 14C are explanatory views of an operation of the pressing guide member.
Figure 14B:
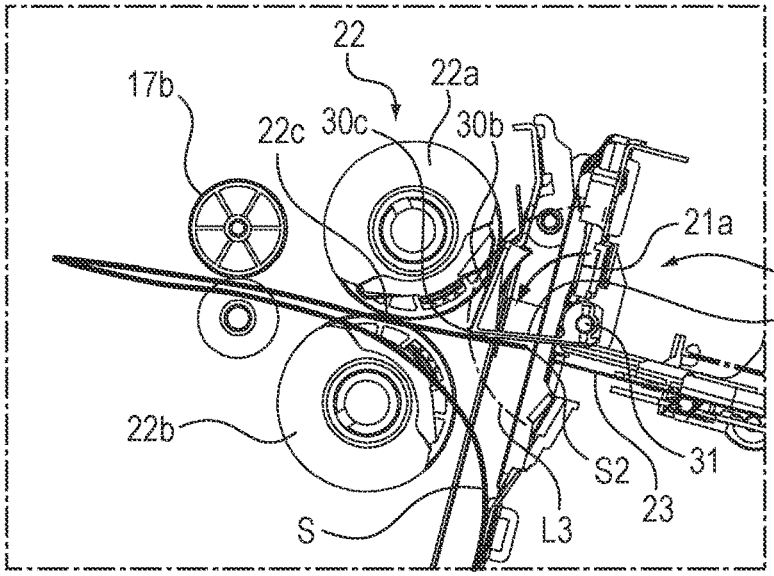
Figure 14C:
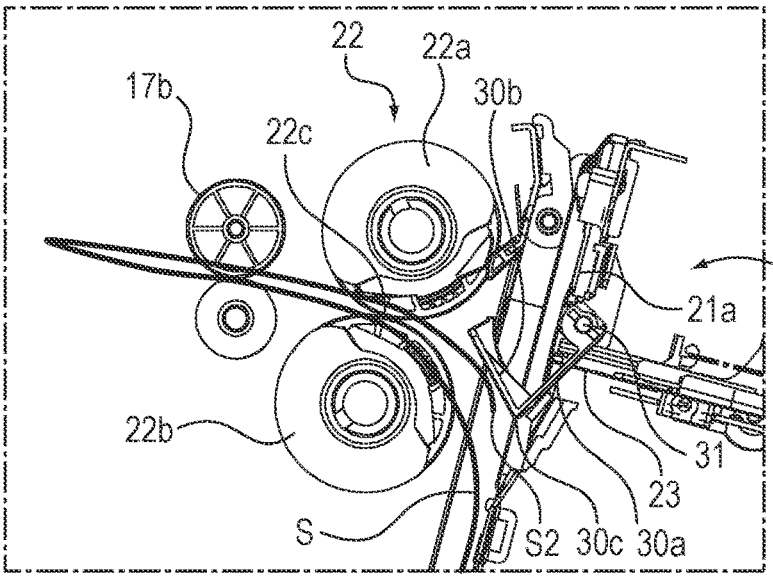

The following describes the pressing guide member 30 (guide member) with reference to FIGS. 12, 13, and 14A to 14C. FIG. 12 is a perspective view of the folding processing apparatus F in a state where the pressing guide member 30 is exposed, FIG. 13 is a view illustrating the relation between the turning locus of the pressing guide member 30 and other components, and FIGS. 14A to 14C are views for explaining the operation of the pressing guide member 30.

<Shape of Pressing Guide Member>

The pressing guide member 30 abuts against the folded end portion S2 (one end portion) of the sheet when the sheet that has been subjected to the first folding processing is switchback-conveyed. Thus, by the pressing guide member 30, the folded end portion S2 of the sheet S is guided to the side where the other end portion of the sheet in the sheet stacking tray 21 is positioned.

As illustrated in FIG. 12 (and FIG. 4), the pressing guide member 30 is disposed on the side opposite to the folding roller pair 22 with respect to the sheet S guided by the guide surface 21*a* of the sheet stacking tray 21. In the present embodiment, three pressing guide members 30 are mounted to a turning shaft 31 as a support member disposed in the sheet width direction so as to be arranged at substantially equal intervals. Two pressing guide members 30 on both sides are disposed at positions that can contact both end portions of the sheet S conveyed along the sheet stacking tray 21, and one center pressing guide member 30 is disposed at a position that can contact substantially the center of the conveyed sheet in the sheet width direction.

The pressing guide member 30 can be turned by the drive force of a pressing guide motor 33. Specifically, the turning shaft 31 is coupled to the pressing guide motor 33 through a drive transmission member 32 such as a drive belt, whereby the turning shaft 31 is turned by the drive force of the pressing guide motor 33, and the three pressing guide members 30 are turned together with the turning shaft 31.

As illustrated in FIG. 13, the pressing guide member 30 has a turning part 30*a* that can be turned about the turning shaft 31 and a guide part 30*b* serving as a first guide surface that abuts against the sheet S to be switchback-conveyed to guide the same. The guide part 30*b* is continuously connected at substantially right angles to the turning part 30*a* to constitute an L-shape. The distal end of the turning part 30*a*, i.e., the corner portion of the L-shape formed by the turning part 30*a* and guide part 30*b* serves as a pressing part 30*c* that presses the sheet S.

The pressing guide member 30 is provided so as to be exposed through a cut formed in the guide surface 21*a*. When the sheet S is carried in the sheet stacking tray 21, the pressing guide member 30 retracts to a retracting position (see FIG. 5A). The retracting position (first position) is set to a position where the turning part 30*a* and the guide surface 21*a* of the sheet stacking tray 21 forms substantially the same plane or a position retracting more away from the sheet conveying path 20 than the guide surface 21*a* so as not to interfere with the movement of the sheet from the image forming apparatus A to the sheet stacking tray 21 through the sheet conveying path 20. By setting the retracting position to the position where the turning part 30*a* and guide surface 21*a* of the sheet stacking tray 21 forms substantially the same plane, the turning part 30*a* functions as a part of the guide surface 21*a* and is thus exploited as a guide surface for guiding the sheet being carried in the sheet stacking tray 21, so that it is possible to prevent the sheet from being caught in the cut formed in the guide surface 21*a*. The position where the turning part 30*a* and guide surface 21*a* forms substantially the same plane includes, in addition to a configuration where the turning part 30*a* and guide surface 21*a* are completely aligned with each other, a configuration where they are misaligned within the range of tolerance.

<Turning Center Position>

As illustrated in FIG. 13, the turning shaft 31, which is the turning center of the pressing guide member 30 in the present embodiment, is disposed upstream, in the conveying direction of the sheet S to be carried in the sheet stacking tray 21, from a nip line L1 connecting the nip part 22*c* of the folding roller pair 22 and the folding blade 23 and on the side opposite to the folding roller pair 22 with respect to the guide surface 21*a* of the sheet stacking tray 21. Further, the turning shaft 31 in the present embodiment is disposed downstream in the sheet conveying direction relative to a rotation axis line L2 running in parallel to the nip line L1 and passing a rotation axis 22*a*1 of the folding roller 22*a*, which is one of the folding rollers 22*a* and 22*b* and closer to the turning shaft 31.

The turning part 30*a* is configured to be turned in a direction that the pressing part 30*c* presses the sheet S to cause the same to be switchback-conveyed.

Thus, as illustrated in FIG. 14A, when the pressing guide member 30 located at the retracting position is turned at switchback-conveyance of the sheet S that has been subjected to the first folding processing, the pressing part 30*c* presses downward the folded end portion S2 of the sheet S from thereabove, as illustrated in FIG. 14B. As a result, the folded end portion S2 is guided, while being switchback-conveyed, to the downstream side (lower side) in the sheet conveying direction of the sheet stacking tray 21 where the sheet S has been carried in before being subjected to the first folding processing.

Further, as illustrated in FIG. 14C, when the pressing guide member 30 is further rotated to cause the pressing part 30*c* to reach at the position of the guide surface 21*a*, the pressing part 30*c* abuts against the sheet S and presses downward the folded end portion S2 of the sheet S. Then, the sheets is drawn from the nip part 22*c* to the guide surface 21*a* and guided in a direction toward the regulating stopper 26 of the sheet stacking tray 21. Thus, even if the folded end portion S2 of the sheet S is curled upward, it is prevented from being fed upward along the sheet stacking tray 21, and the sheet S is conveyed downward without fail.

<Turning Area of Turning Part>

As illustrated in FIG. 13, the length of the turning part 30*a* of the pressing guide member 30 according to the present embodiment, i.e., the length from the turning shaft 31 as a turning fulcrum to the pressing part 30*c* is configured to be longer than the shortest distance from the first roller surface 22*a*2 of the folding roller 22*a*, which is one of the folding rollers 22*a* and 22*b* closer to the turning shaft 31, and shorter than the shortest distance from the second roller surface 22*a*3.

By setting the length of the turning part 30*a* longer than the shortest distance from the first roller surface 22*a*2, and by making the second roller surfaces 22*a*3 and 22*b*3 of the folding roller pair 22 face the turning part 30*a* when the pressing guide member 30 is turned from the retracting position to the sheet conveying path 20 side, it is possible to turn the pressing guide member 30 without making the turning part 30*a* interfere with the folding roller pair 22. Further, the length of the turning part 30*a* is greater than the shortest distance from the first roller surface 22*a*2 of the folding roller 22*a*, the pressing part 30*c* can abut against the sheet to be switchback-conveyed at a position closer to the nip part 22*c* than when the length of the turning part 30*a* is shorter than the shortest distance from the first roller surface 22*a*2. This allows the sheet S to be guided stably to the sheet stacking tray 21.

The position where the pressing part 30*c* of the pressing guide member 30 abuts against the sheet being switchback-conveyed by the folding roller pair 22 to guide the folded end portion S2 of the sheet to the side where the other end portion of the sheet in the sheet stacking tray 21 is positioned is referred to as a guide position (second position). This guide position is configured outside the area between the rotation locus of the first roller surface 22*a*2 and the rotation locus of the second roller surface 22*a*3. With this configuration, when the pressing guide member 30 abuts against and guides the sheet, the first roller surface 22*a*2 of the folding roller 22*a* rotated for sheet switchback-conveyance and pressing guide member 30 can be prevented from interfering with each other. That is, when being turned from the retracting position to the guide position, the pressing guide member 30 enters the area between the rotation locus of the first roller surface 22*a*2 and the rotation locus of the second roller surface 22*a*3 and abuts against the sheet at the guide position outside this area. The retracting position of the pressing guide member 30 is also positioned outside the area between the rotation locus of the first roller surface 22*a*2 and the rotation locus of the second roller surface 22*a*3.

As described above, in the present embodiment, the pressing part 30*c* of the pressing guide member 30 abuts, at the guide position, against the sheet being switchback-conveyed by the folding roller pair 22 and presses downward and guides the sheet. However, when at least the pressing guide member 30 enters the above area defined by the moving locus of the folding roller 22*a* upon moving from the retracting position to the guide position and abuts against the sheet at the guide position outside the above area to guide the sheet to the above position, the sheet can be stably guided to the sheet stacking tray 21.

When the length of the turning part 30*a* is increased, it is necessary to dispose the turning shaft 31 at a position away from the folding blade 23 in the sheet conveying direction in order to prevent interference between the pressing guide member 30 being rotated and the folding blade 23. This involves the necessity of disposing the turning shaft 31 at a position away from also the folding roller pair 22. In this regard, in the present embodiment, as described above, the turning shaft 31 is disposed between the nip line L1 and the rotation axis line L2 in the sheet conveying direction, so that it is possible to bring the position where the pressing part 30*c* presses the switchback-conveyed sheet closer to the nip part 22*c* without unnecessarily increasing the length of the turning part 30*a*.

As illustrated in FIG. 13, the guide part 30*b* of the pressing guide member 30 according to the present embodiment has a shape falling within a turning locus L3 of the turning part 30*a* and not protruding therefrom. Thus, even when the turning part 30*a* having an increased length as described above is turned, the guide part 30*b* does not interfere with the folding roller pair 22.

As described above, the sheet that has been subjected to the first folding processing is switchback-conveyed to the sheet stacking tray 21 while being guided by the pressing guide member 30. After completion of the sheet switchback conveyance, i.e., after the sheet abuts against the regulating stopper 26, the pressing guide member 30 is moved to a position slightly protruding to the sheet conveying path 20 from the guide surface 21*a* (see FIG. 8B).

After that, the regulating stopper 26 is elevated to reversely convey the sheet such that the second folding position aligns with the folding blade 23. Since the pressing guide member 30 is located at the position slightly protruding to the sheet conveying path 20 from the guide surface 21*a*, the sheet S is conveyed while being guided by the turning part 30*a* of the pressing guide member 30 without being caught in a cut or the like which is formed in the guide surface 21*a* so as to mount the pressing guide member 30 (see FIG. 9A). After the second folding position of the sheet reaches the position aligned with the folding blade 23, the pressing guide member 30 is returned to the retracting position.

<Position Control of Folding Roller Pair and Pressing Guide Member>

The following describes the position control of the folding roller pair 22 and pressing guide member 30.

Figure 23A:
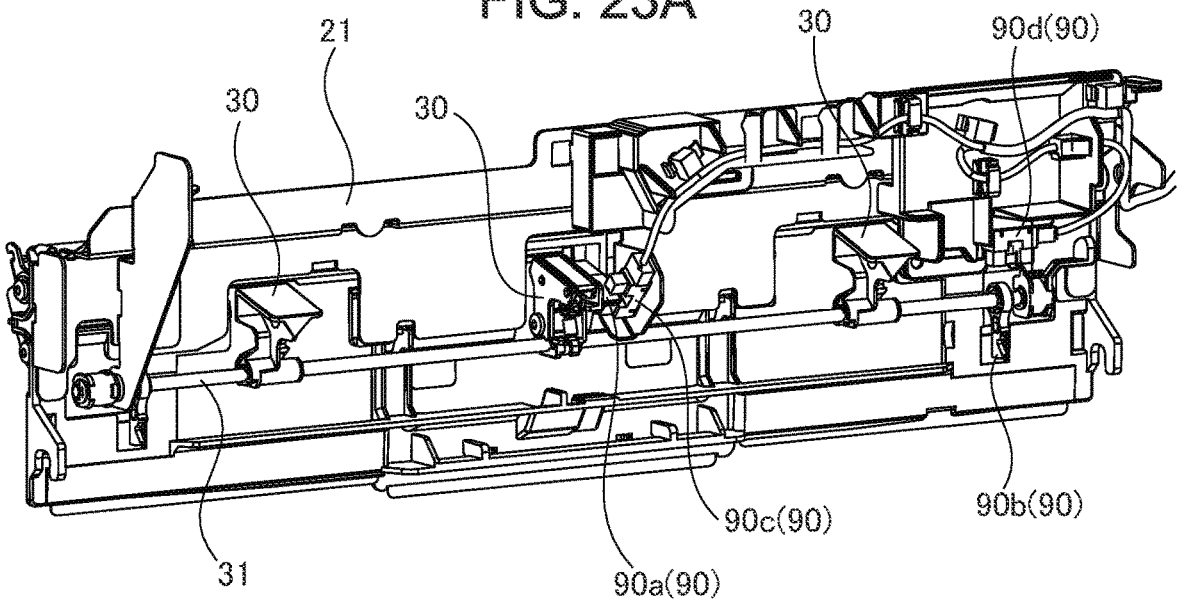
FIGS. 23A and 23B are perspective views illustrating the pressing guide member and its surroundings in the sheet folding processing apparatus.
Figure 23B:
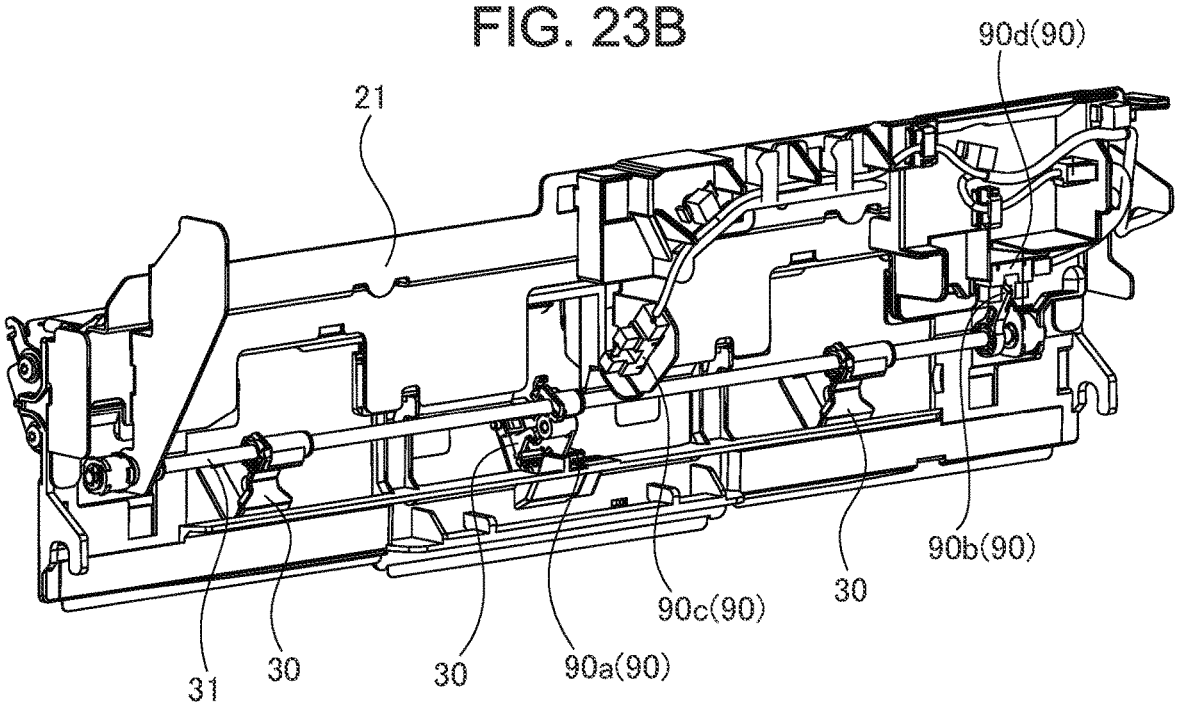
Figure 24A:
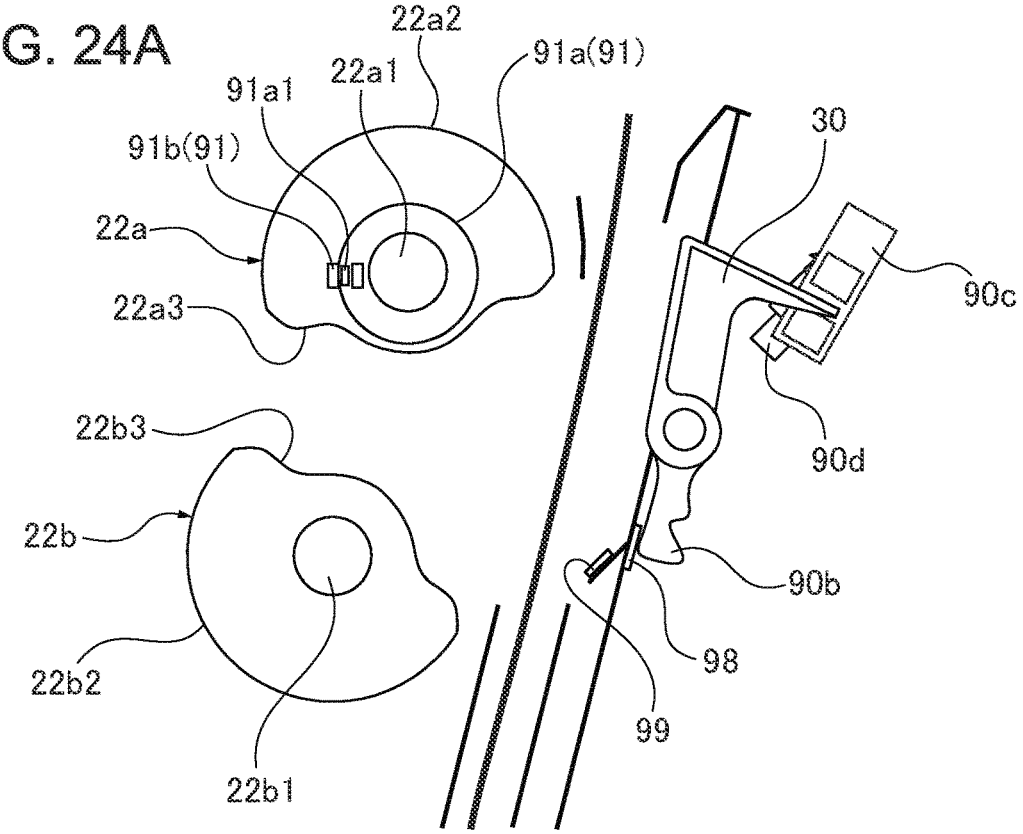
FIGS. 24A and 24B are cross-sectional views schematically illustrating the folding roller pair and pressing guide member.
Figure 24B:
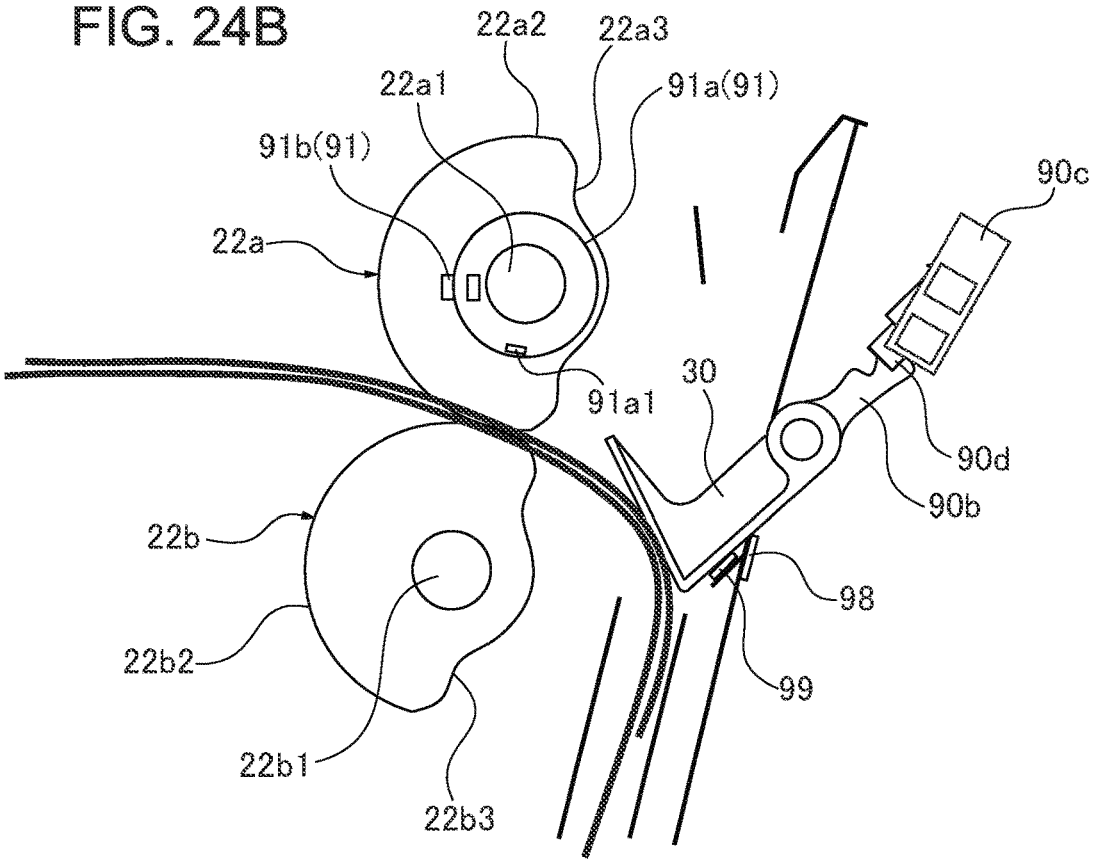

FIGS. 23A and 23B are perspective views of the pressing guide member 30 and its vicinity in the folding processing apparatus F as viewed from the back surface side (opposite side with respect to the sheet conveying path 20) of the guide surface 21*a* of the sheet stacking tray 21. FIGS. 24A and 24B are schematic cross-sectional views of the folding roller pair 22 and pressing guide member 30. FIGS. 23A and 24A illustrate a state where the pressing guide member 30 is at the retracting position. FIGS. 23B and 24B illustrate a state where the pressing guide member 30 is at the guide position.

As illustrated in FIGS. 23A, 23B, 24A, and 24B, the folding processing apparatus F has a pressing guide position detecting unit 90 that detects that the pressing guide member 30 is located at the retracting position or guide position. The pressing guide position detecting unit 90 includes two flags 90*a* and 90*b* which are rotated in sync with the pressing guide member 30 and two optical sensors 90*c* and 90*d* which are disposed around the flags 90*a* and 90*b*, respectively.

The flag 90*a* is mounted to the pressing guide member 30 located at the center in the sheet width direction. The optical sensor 90*c* is disposed at a position detecting the flag 90*a* when the pressing guide member 30 is at the retracting position. When detecting the flag 90*a*, the optical sensor 90*c* outputs a detection signal to a control part 60 (FIG. 20). That is, the flag 90*a* and optical sensor 90*c* constitute a detection part (first detection part) that detects that the pressing guide member 30 is at the retracting position. The retracting position is the home position of the pressing guide member 30, and the pressing guide member 30 is returned to the home position at, for example, power-on of the sheet processing apparatus B by initialization control to be described later. In the present embodiment, a transmission type phototransistor is used as the optical sensor 90*c*; however, the optical sensor 90*c* to be used in the present embodiment is not limited to this, and may be a transmission type optical sensor of other type or a reflective type optical sensor.

The flag 90*b* is axially supported by the turning shaft 31 at a position outside the sheet conveying area in the sheet width direction. The optical sensor 90*d* is disposed at a position detecting the flag 90*b* when the pressing guide member 30 is at the guide position. When detecting the flag 90*b*, the optical sensor 90*d* outputs a detection signal to a control part 60. That is, the flag 90*b* and optical sensor 90*d* constitute a detection part (third detection part) that detects that the pressing guide member 30 is at the guide position. In the present embodiment, a transmission type phototransistor is used as the optical sensor 90*d*; however, the optical sensor 90*d* to be used in the present embodiment is not limited this, and may be a transmission type optical sensor of other type or a reflective type optical sensor.

The control part 60 causes the pressing guide motor 33 to rotate in a normal direction (first rotation direction) when moving the pressing guide member 30 from the guide position to the retracting position. This causes the pressing guide member 30 to be turned from the guide position to the retracting position. When receiving the detection signal of the flag 90*a* from the optical sensor 90*c*, the control part 60 stops driving the pressing guide motor 33. The turning shaft 31 is rotated by inertial force even after stop of the drive of the pressing guide motor 33, and the pressing guide member 30 and flags 90*a* and 90*b* are also turned accordingly. The flag 90*b* turned by inertial force abuts against a regulating part 98 provided at the back surface side of the guide surface 21*a* of the sheet stacking tray 21. This regulates the rotation of the turning shaft 31 to thereby fix the pressing guide member 30 to the retracting position. The regulating part 98 is made of an elastic body such as rubber so as to reduce impact and vibration when the flag 90*b* abuts thereagainst. In this way, the pressing guide member 30 is moved from the guide position to retracting position.

The control part 60 causes the pressing guide motor 33 to rotate in a reverse direction (second rotation direction) when moving the pressing guide member 30 from the retracting position to the guide position. This causes the pressing guide member 30 to be turned from the retracting position to the guide position. When receiving the detection signal of the flag 90*b* from the optical sensor 90*d*, the control part 60 stops driving the pressing guide motor 33. The turning shaft 31 is rotated by inertial force even after stop of the drive of the pressing guide motor 33, and the pressing guide member 30 is also turned accordingly. The pressing guide member 30 being turned by inertial force abuts against a regulating part 99 provided in the sheet stacking tray 21. This regulates the rotation of the turning shaft 31 to thereby fix the pressing guide member 30 to the guide position. The regulating part 99 is made of an elastic body such as rubber so as to reduce impact and vibration when the pressing guide member 30 abuts thereagainst. In this way, the pressing guide member 30 is moved from the retracting position to the guide position.

Further, the folding processing apparatus F has a folding roller position detecting unit 91 (second detection part) that detects that the folding roller pair 22 is located at a home position to be described later. The folding roller position detecting unit 91 includes a flag holding roller 91*a* axially supported by the rotary shaft 22*a*1 of the folding roller 22*a* and having a flag 91*a*1 and an optical sensor 91*b* disposed at a circumferential location of the flag holding roller 91*a*.

The flag holding roller 91*a* is axially supported by the rotary shaft 22*a*1 of the folding roller 22*a* and is thus rotated in sync with the folding roller 22*a*. The optical sensor 91*b* is disposed at a position detecting the flag 91*a*1 when the folding roller pair 22 is located at a home position where the second roller surface 22*a*3 of the folding roller 22*a* and the second roller surface 22*b*3 of the folding roller 22*b* are separated from each other in a mutually facing state (see FIG. 24A). At this home position, the folding roller pair 22 does not interfere with the turning of the pressing guide member 30. When detecting the flag 91*a*1, the optical sensor 91*b* outputs a detection signal to the control part 60. In the present embodiment, a transmission type phototransistor is used as the optical sensor 91*b*; however, the optical sensor 91*b* to be used in the present embodiment is not limited this, and may be a transmission type optical sensor of other type or a reflective type optical sensor. Further, the configuration of the flag 91*a*1 is not limited to that of the present embodiment as long as it can be rotated in sync with the rotation of the folding roller 22*a*. For example, the flag 91*a*1 may be provided on the side surface of a gear for transmitting the drive force of the folding roller motor 61 to the folding roller pair 22, or may be provided to a rotary shaft of the gear.

<Blade Guide Member>

After the second folding position of the switchback-conveyed sheet is thus moved to a position aligned with the folding blade 23, the pressing guide member 30 is moved to the retracting position, and the folding blade 23 is operated to perform the second folding processing. At this time, the blade guide member 40 provided above the folding blade 23 guides the folded end portion S2 of the sheet (see FIG. 10B).

Figure 15A:
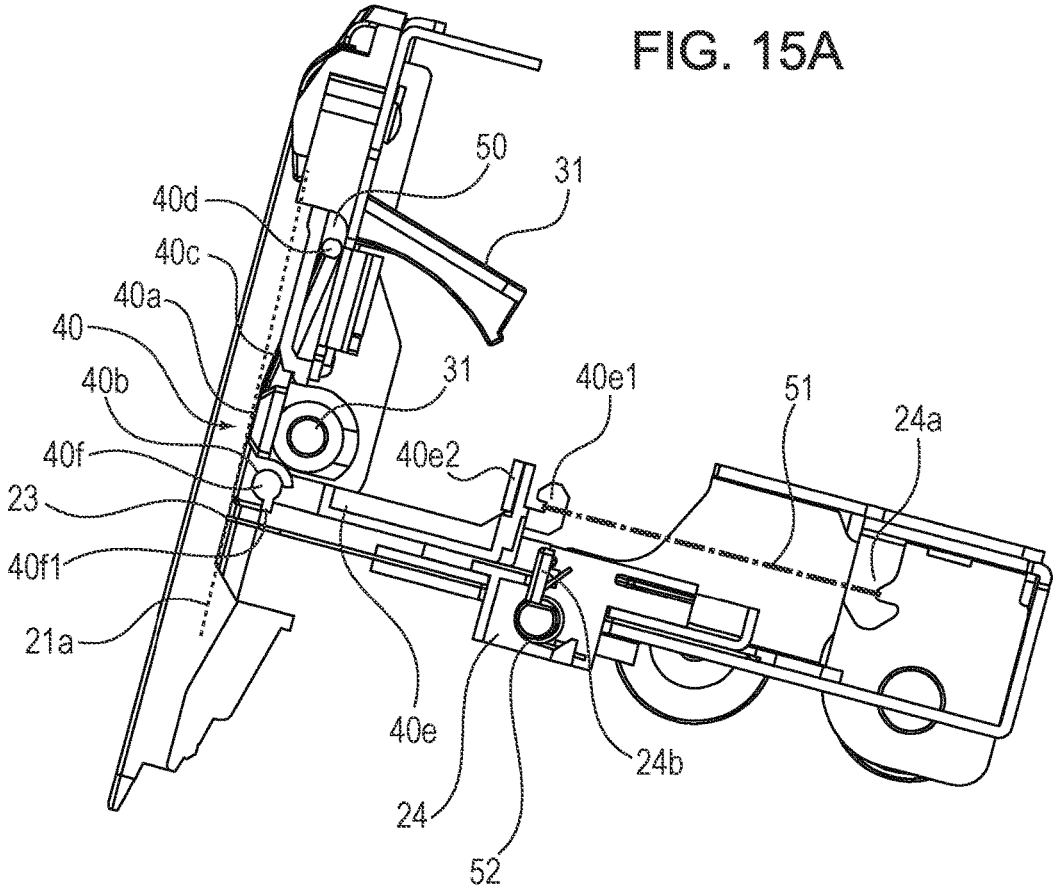
FIGS. 15A and 15B are cross-sectional views explaining an operation of the folding blade and a blade guide member.

The following describes the configuration and operation of the blade guide member 40 with reference to FIGS. 15A to 19B. FIGS. 15A and 15B are views for explaining the turning operation of the blade guide member 40, and FIGS. 16A to 19B are views illustrating the operations of the folding blade 23 and the blade guide member 40 when the sheet second folding processing is performed.

<Configuration of Blade Guide Member>

The blade guide member 40 is configured to move in the thrust direction of the folding blade 23 when the second folding processing is performed for the sheet S to guide the sheet end portion of the folded side that has been formed in the first folding processing, i.e., the sheet folded end portion S2 in the thrust direction to assist conveyance of the folded end portion S2 to the nip part 22*c* of the folding roller pair 22. To this end, as illustrated in FIG. 15, the blade guide member 40 has an abutting part 40*a* that abuts against the sheet rear end and a fitting hole part 40*b* having a partial cut at one side end portion of the abutting part 40*a*, and the fitting hole part 40*b* is turnably fitted to a shaft part 40*f* formed in a base part 40*e*. Further, an arm part 40*c* is integrally provided at the other side end portion of the abutting part 40*a*, and an engaging projection 40*d* is formed at an end portion of the arm part 40*c*. The engaging projection 40*d* is slidably engaged with an elongated hole 50 formed in the frame of the sheet processing apparatus B. The elongated hole 50 is formed substantially parallel to the guide surface 21*a* of the sheet stacking tray 21 at a portion above the blade carrier 24.

The base part 40*e* is mounted to the blade carrier 24 so as to be slidable in a direction parallel to the moving direction of the blade carrier 24. A tensile spring 51 is mounted between a locking part 40*e*1 formed in the base part 40*e* and a locking part 24*a* formed in the blade carrier 24.

The blade carrier 24 has a pressing projection 24*b* that can abut against and press the base part 40*e*. The pressing projection 24*b* is turnably provided in the blade carrier 24 and is biased in the counterclockwise direction in FIGS. 15A and 15B by a coil spring 52 mounted to the turning shaft thereof. Thus, when the blade carrier 24 is moved in the blade thrust direction, the pressing projection 24*b* abuts against and presses the base part 40*e*, with the result that the blade guide member 40 is moved integrally with the blade carrier 24. The coil spring 52 provided to the pressing projection 24*b* acts as a so-called torque limiter and is turned in the clockwise direction when a clockwise force not less than a predetermined value is applied to the pressing projection 24*b*.

<Change in Angle of Abutting Part to Moving Direction of Folding Blade>

Figure 15B:
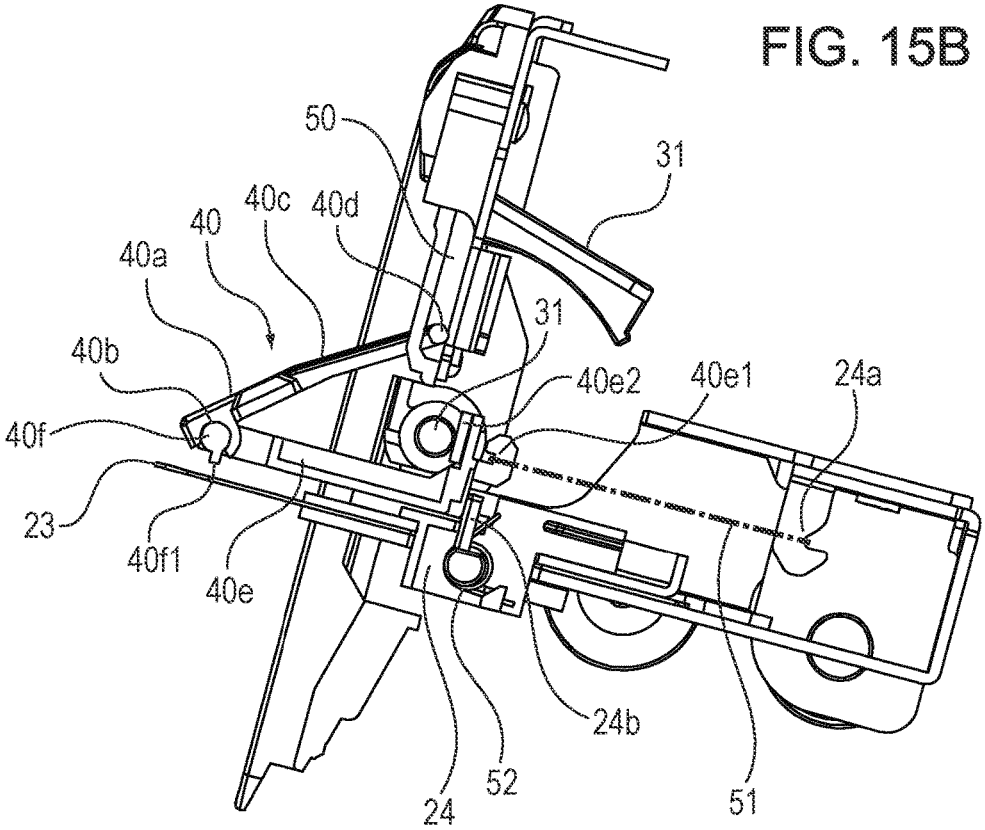

In the above configuration, when the blade carrier 24 is at its home position, the blade guide member 40 is pulled by the tensile spring 51, and the abutting part 40*a* abuts against the turning shaft 31 as the turning fulcrum of the pressing guide member 30, as illustrated in FIG. 15A. This is a state where the blade guide member 40 is at its home position. In this state, the abutting part 40*a* is erected so as to be substantially flush with the guide surface 21*a*. When the blade carrier 24 is moved in the blade thrust direction, the blade guide member 40 is pressed by the pressing projection 24*b* to be moved from its home position together with the blade carrier 24 to a position at which an abutting part 40*e*2 formed at the rear end of the base part 40*e* so as to be erected abuts against the turning shaft 31, as illustrated in FIG. 15B.

When the blade guide member 40 is moved in the blade thrust direction as described above, the engaging projection 40*d* is guided by the elongated hole 50 to be slid downward, causing the abutting part 40*a* to be turned about the shaft part 40*f*. Accordingly, in the state illustrated in FIG. 15A where the blade guide member 40 is at the home position, the abutting part 40*a* is erected substantially perpendicular to the moving direction of the blade carrier 24, i.e., the moving direction of the folding blade 23. Then, as the blade carrier 24 is moved in the thrust direction of the folding blade 23, the abutting part 40*a* is turned downward to the upstream side in the thrust direction of the folding blade 23 as illustrated in FIG. 15B. That is, the angle of the abutting part 40*a* with respect to the moving direction of the blade carrier 24 becomes acute with the movement of the blade carrier 24.

Further, as illustrated in FIG. 15A, the shaft part 40*f* as the turning shaft of the abutting part 40*a* has a projection 40*f*1. On the other hand, the cut formed in the fitting hole part 40*b* to which the shaft part 40*f* fits has a wider size than the width of the projection 40*f*1. Thus, the blade guide member 40 can be turned within the range of the cut.

In the above configuration, when the blade carrier 24 is moved to the home position, the base part 40*e* is pulled by the tensile spring 51. At this time, the cut surface of the fitting hole part 40*b* abuts against the projection 40*f*1 to regulate further turning of the abutting part 40*a*. This regulates further movement of the blade guide member 40 in a state where the abutting part 40*a* abuts against the turning shaft 31, and the abutting part 40*a* is maintained in an erected state at the home position of the blade guide member 40.

Further, in the blade guide member 40 according to the present embodiment, the abutting part 40*a* and arm part 40*c* are each formed of a linear member in cross section, and the arm part 40*c* is inclined at a predetermined angle with respect to the abutting part 40*a*. Thus, when the abutting part 40*a* is substantially flush with the guide surface 21*a* in a state where the blade guide member 40 is at the home position, the end portion of the arm part 40*c* on the side where the engaging projection 40*d* is positioned is located separated from the guide surface 21*a* toward the side opposite to the folding roller pair 22. This allows the elongated hole 50 with which the engaging projection 40*d* is engaged to be disposed separated from the guide surface 21*a* toward the side opposite to the folding roller pair 22, preventing interference between the elongated hole 50 and the guide surface 21*a*. Thus, in a state where the blade guide member 40 is at the home position, the abutting part 40*a* can function as a guide part for the sheet conveyed along the sheet stacking tray 21.

<Operation of Folding Blade and Blade Guide Member>

The following describes the operation of the blade guide member 40 when the folding blade 23 is operated to perform the sheet second folding processing with reference to FIGS. 16A to 19B.

Figure 16A:
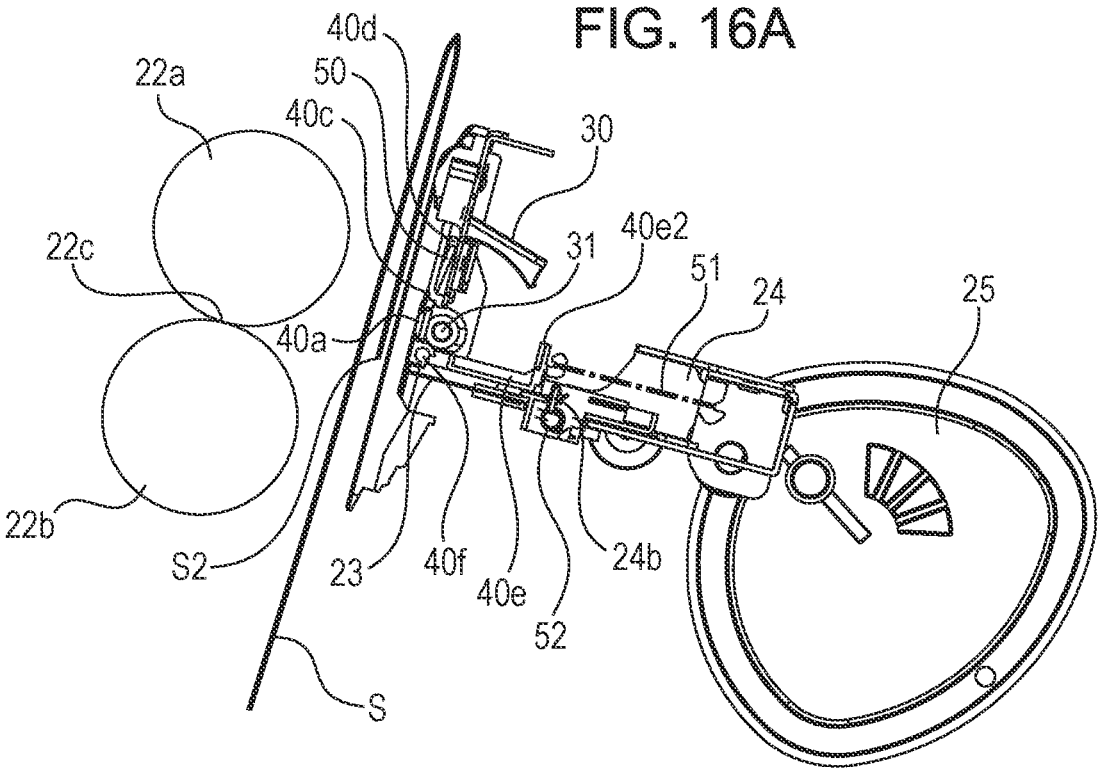
FIGS. 16A and 16B are cross-sectional views explaining the operation of the folding blade and blade guide member.

FIG. 16A illustrates a state where the blade carrier 24 is at its home position and, in this state, the blade guide member 40 is also at its home position. In the following description, the direction in which the blade carrier 24 thrusts the folding blade 23 from the home position toward the nip part 22*c* of the folding roller pair 22 is referred to as "thrust direction", and the direction in which the blade carrier 24 returns the folding blade 23 from the nip part 22*c* to home position is referred to as "return direction".

When the blade guide member 40 is at its home position, the folding blade 23 is also at its home position, and the distal end of the folding blade 23 is substantially flush with or slightly separated from the guide surface 21*a* in the return direction and is thus separated from the sheet S on the sheet stacking tray 21. This prevents the sheet conveyed along the sheet stacking tray 21 while being guided by the guide surface 21*a* from being caught by the distal end of the folding blade 23. Even in a case where the distal end of the folding blade 23 protrudes from the guide surface 21*a* toward the folding roller pair 22 side, unless the sheet to be conveyed to the sheet stacking tray 21 using another guide member is caught by the blade distal end, the blade distal end can be considered as retracting from the sheet conveying path, so that the position of the folding blade 23 in this case can be set to the home position thereof. In a state where the blade guide member 40 is at the home position, the abutting part 40*a* of the blade guide member 40 abuts against the turning shaft 31. At this time, the pressing projection 24*b* is separated from the base part 40*e*.

Figure 16B:
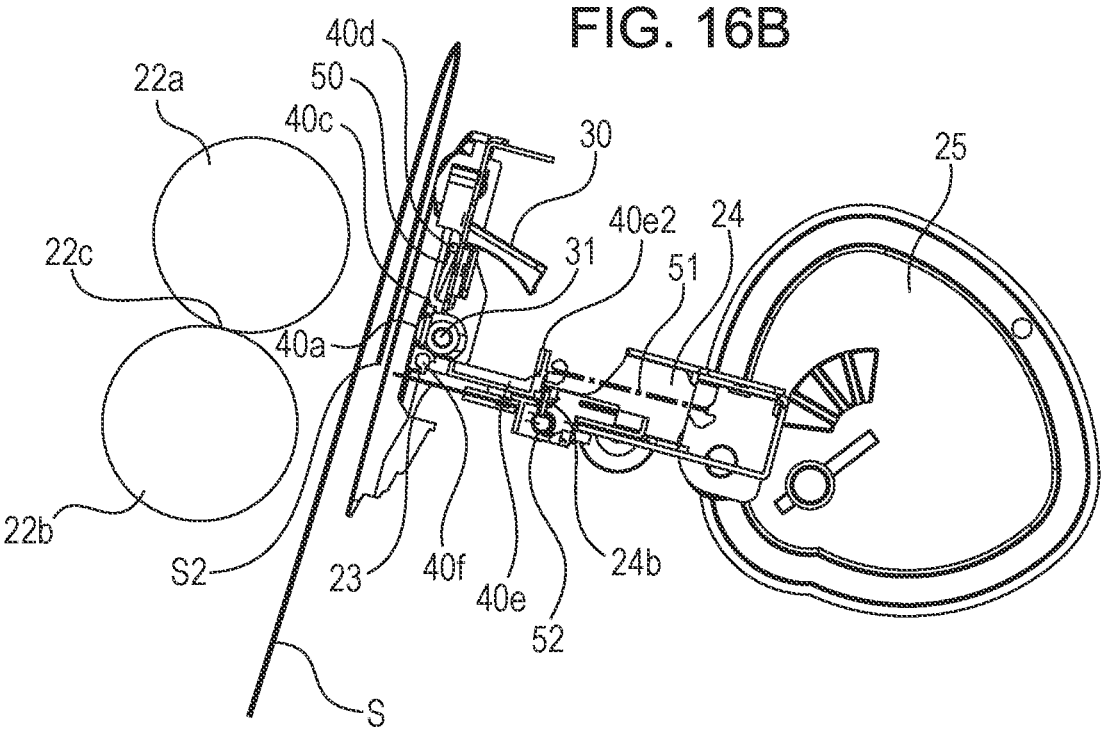

When a cam drive motor is driven to thrust the folding blade 23, the cam member 25 is rotated to move the blade carrier 24 in the thrust direction. Then, the pressing projection 24*b* abuts against the base part 40*e* to move the blade guide member 40 in the thrust direction integrally with the blade carrier 24 and folding blade 23 (FIG. 16B). At this time, the distal end of the folding blade 23 protrudes from the distal end of the blade guide member 40 in the thrust direction.

Figure 17A:
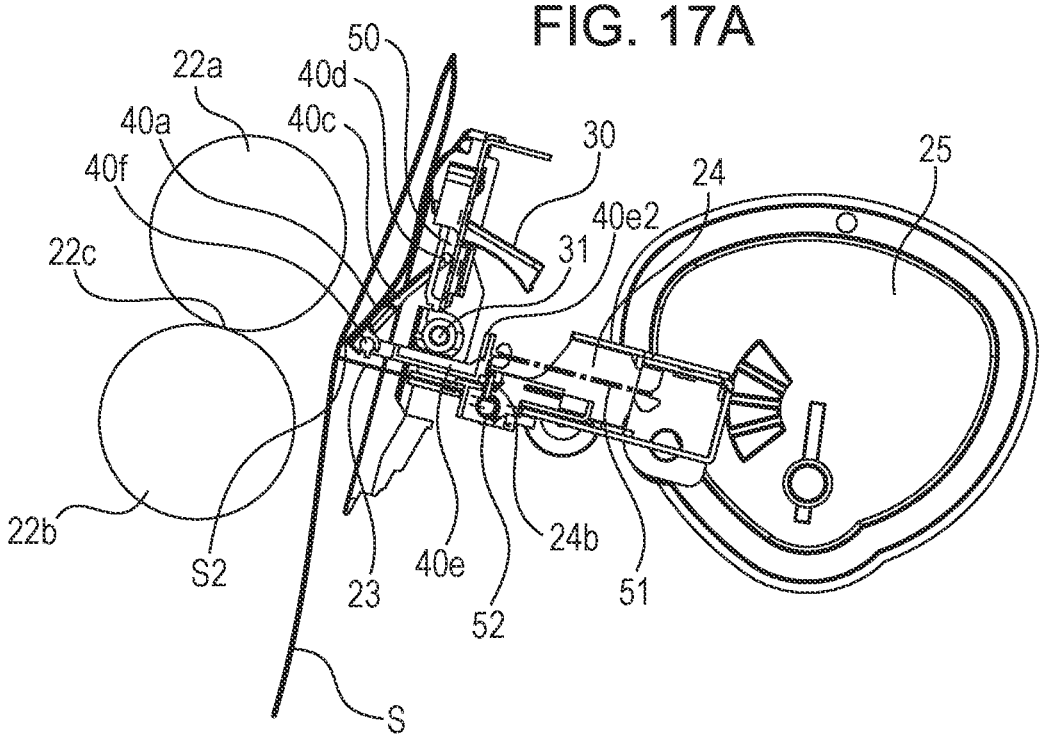
FIGS. 17A and 17B are cross-sectional views explaining the operation of the folding blade and blade guide member.

When the blade carrier 24 is further moved in the thrust direction, the distal end of the folding blade protrudes by a predetermined amount. Then, as illustrated in FIG. 17A, the distal end of the folding blade 23 abuts against the sheet S that has been subjected to the first folding processing and that is stopped in the sheet stacking tray 21 with the second folding position facing the folding blade 23. At this time, since the distal end of the folding blade 23 protrudes from the blade guide member 40 in the thrust direction as described above, the folding blade 23 abuts against the folding position of the sheet S earlier than the blade guide member 40. Thus, with the thrust of the folding blade 23, the folding blade distal end facing the sheet folding position abuts accurately against the folding position without misalignment, whereby the sheet S is folded at the accurate folding position.

The folding blade distal end may not necessarily protrude from the blade guide member 40, and misalignment between the blade distal end and the sheet folding position can be suppressed so long as the blade distal end is at the same position as the blade guide member 40 in the thrust direction.

When the blade carrier 24 is moved in the thrust direction in the above state, the second folding position of the sheet S is thrust toward the nip part 22*c* of the folding roller pair 22 by the folding blade 23. At the same time, the abutting part 40*a* of the blade guide member 40 abuts against the folded end portion S2 of the sheet that has been subjected to the first folding processing and guides the folded end portion S2 so as to push the folded end portion S2 to the nip part 22*c* (FIG. 17B).

The blade guide member 40 thus guides the folded end portion S2 of the sheet to the nip part 22*c*, so that the folded end portion S2 of the sheet is moved toward the nip part 22*c* without being curled. Further, when approaching the nip part 22*c*, the thrust blade guide member 40 may interfere with the outer peripheral surfaces of the folding rollers 22*a* and 22*b*. However, at this time, in the blade guide member 40 according to the present embodiment, the angle of the abutting part 40*a* with respect to the thrust direction becomes acute with further movement of the blade guide member 40 in the thrust direction (the angle of the abutting part 40*a* changes from the state illustrated in FIG. 17A to the state illustrated in FIG. 17B). This allows the abutting part 40*a* to be brought closer to the vicinity of the nip part 22*c* and thus to reliably guide the folded end portion S2 of the sheet to the nip part 22*c*.

Figure 17B:
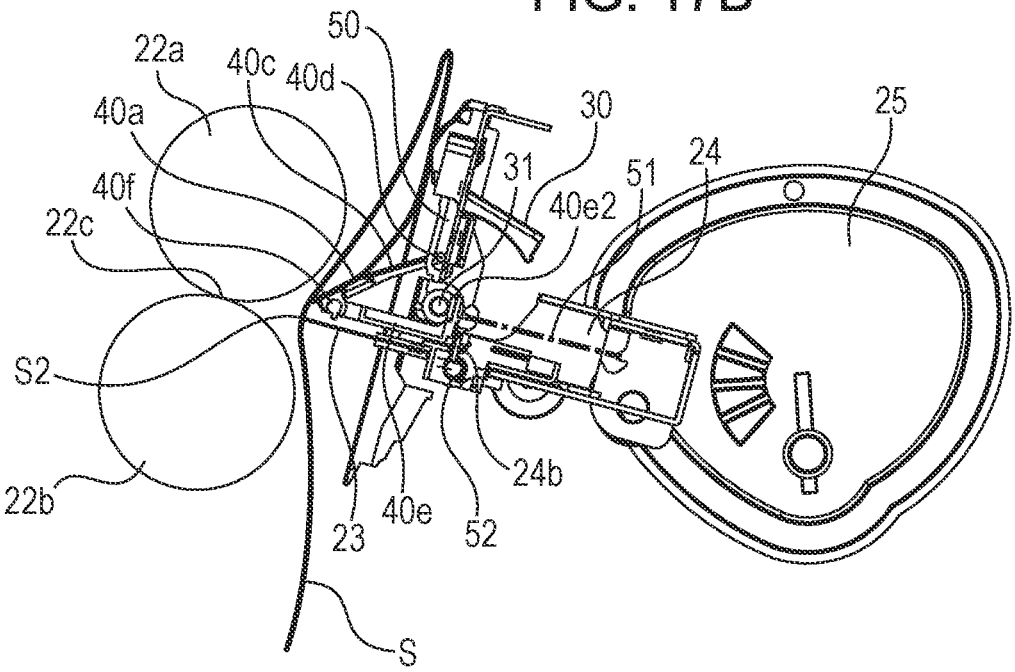
Figure 18A:
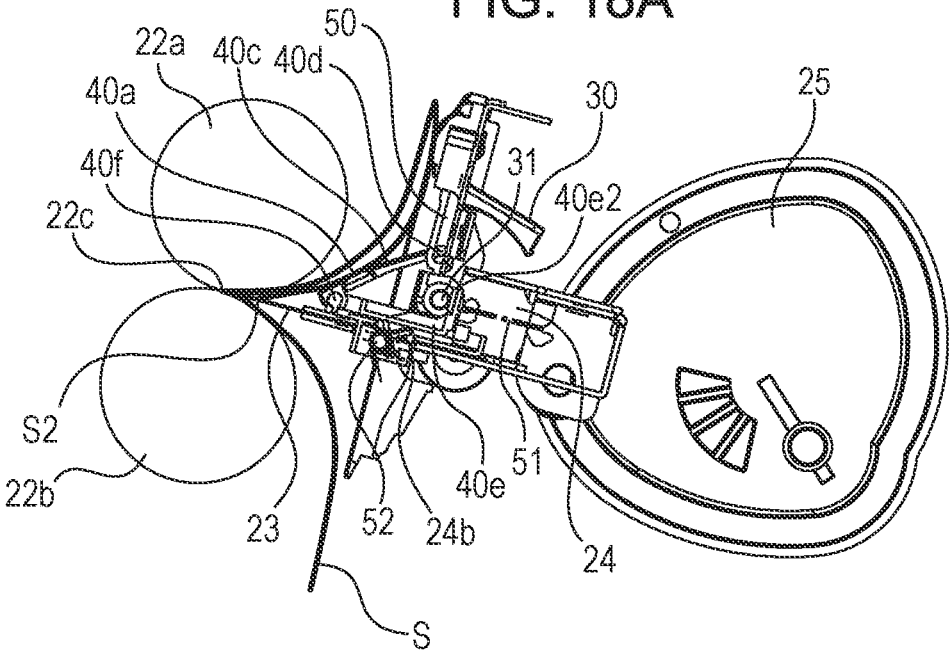
FIGS. 18A and 18B are cross-sectional views explaining the operation of the folding blade and blade guide member.

When the blade carrier 24 is further moved in the thrust direction to cause the abutting part 40*e*2 to abut against the turning shaft 31 as illustrated in FIG. 17B, further movement of the blade guide member 40 in the thrust direction is regulated. In a state where the blade guide member 40 is maximally moved in the thrust direction, the distal end (end portion on the folding roller pair 22 side in the thrust direction) of the blade guide member 40 protrudes from the tangential line connecting the outer peripheries of the folding rollers 22*a* and 22*b* on the sheet stacking tray 21 side toward the nip part 22*c* side. On the other hand, when the blade carrier 24 is pushed in the thrust direction by the rotation of the cam member 25, the pressing projection 24*b* is rotated in the clockwise direction against the biasing force of the coil spring 52 because a force not less than a predetermined value is applied to the coil spring 52 and gets under the base part 40*e*, as illustrated in FIG. 18A. This prevents the pressing projection 24*b* from pressing the blade guide member 40, with the result that, while the blade guide member 40 is in a stopped state, only the folding blade 23 is moved in the thrust direction. Thus, the blade distal end maximally protrudes to be moved to a thrust position at which it thrusts the sheet S to the nip part 22*c*. At this time, the distal end of the folding blade 23 protrudes more than the distal end of the abutting part 40*a* of the blade guide member 40. That is, the distance between the blade distal end at the thrust position and the abutting part distal end is larger than the distance between the blade distal end when it abuts against the sheet S stopped in the sheet stacking tray 21 and the abutting part distal end. This allows the sheet to be reliably drawn into the nip part 22*c* of the rotating folding roller pair 22 in a state of being folded at the second folding position and the sheet leading end S1 to be also drawn into the nip part 22*c*, whereby the sheet is folded in three.

There may be a case where a large load is applied to the blade guide member 40 in the return direction in a state where the folding blade thrusts the sheet, i.e., during movement of the distal end of the folding blade 23 from a position where the blade distal end abuts against the sheet S being stopped in the sheet stacking tray 21 toward the thrust position. For example, when folding processing is performed for a plurality of sheets with high rigidity in a superimposed condition, a large load is applied to the blade guide member 40 during folding processing. To cope with this, when a load not less than a predetermined value is applied, the blade guide member 40 can move in the return direction relative to the folding blade 23 against the friction force with the pressing projection 24*b* which is brought into pressure contact with the bottom surface of the base part 40*e* by the biasing force of the coil spring 52. Thus, when being applied with a large load during sheet folding processing, the blade guide member 40 will not be damaged.

Figure 18B:
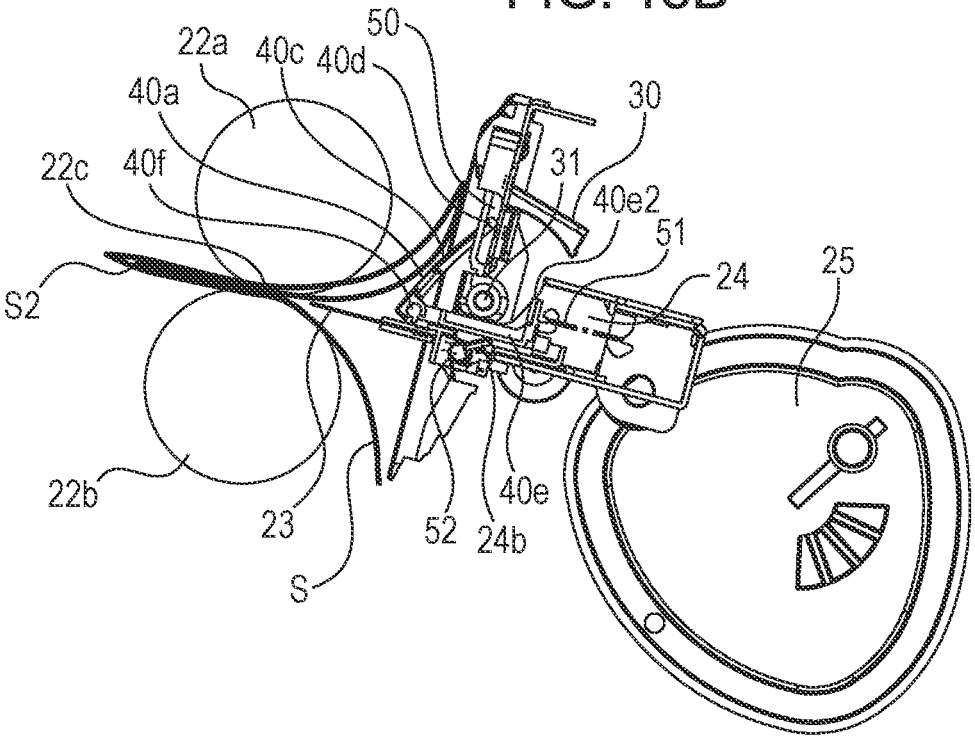

When the cam member 25 is further rotated after the folding blade distal end reaches the thrust position, the blade carrier 24 is moved in the return direction together with the folding blade 23 (FIG. 18B). At this time, since the pressing projection 24*b* is brought into pressure contact with the base part 40*e* of the blade guide member 40 by the biasing force of the coil spring 52 as described above, the blade guide member 40 is moved integrally with the blade carrier 24 by the friction force between the pressing projection 24*b* and the bottom surface of the base part 40*e*, that is, the blade guide member 40 is moved in the return direction simultaneously with the folding blade 23.

Figure 19A:
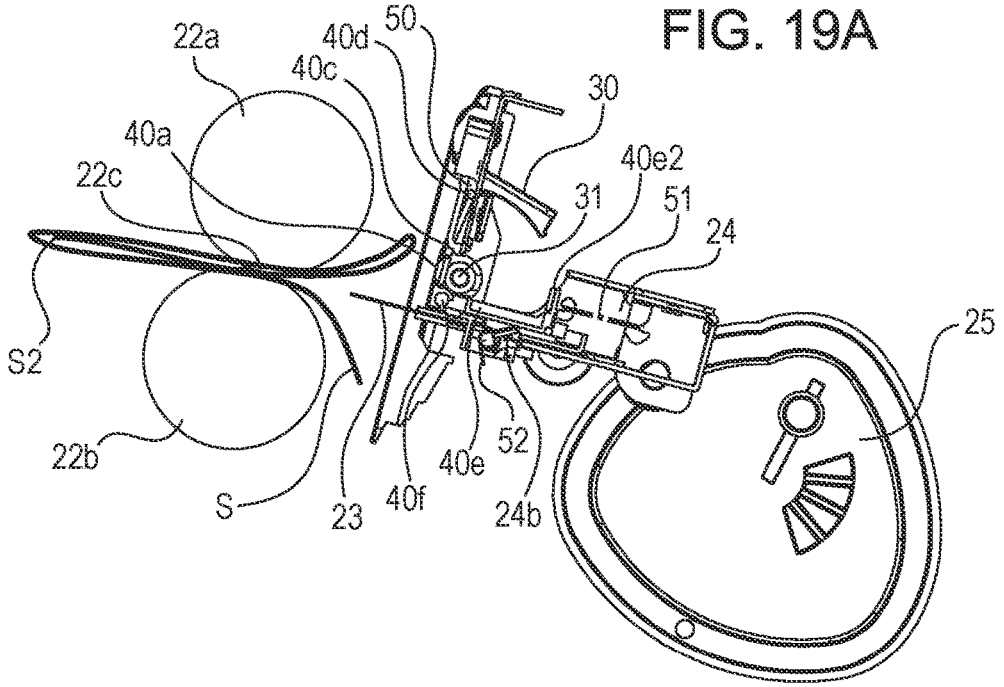
FIGS. 19A and 19B are cross-sectional views explaining the operation of the folding blade and blade guide member.
Figure 19B:
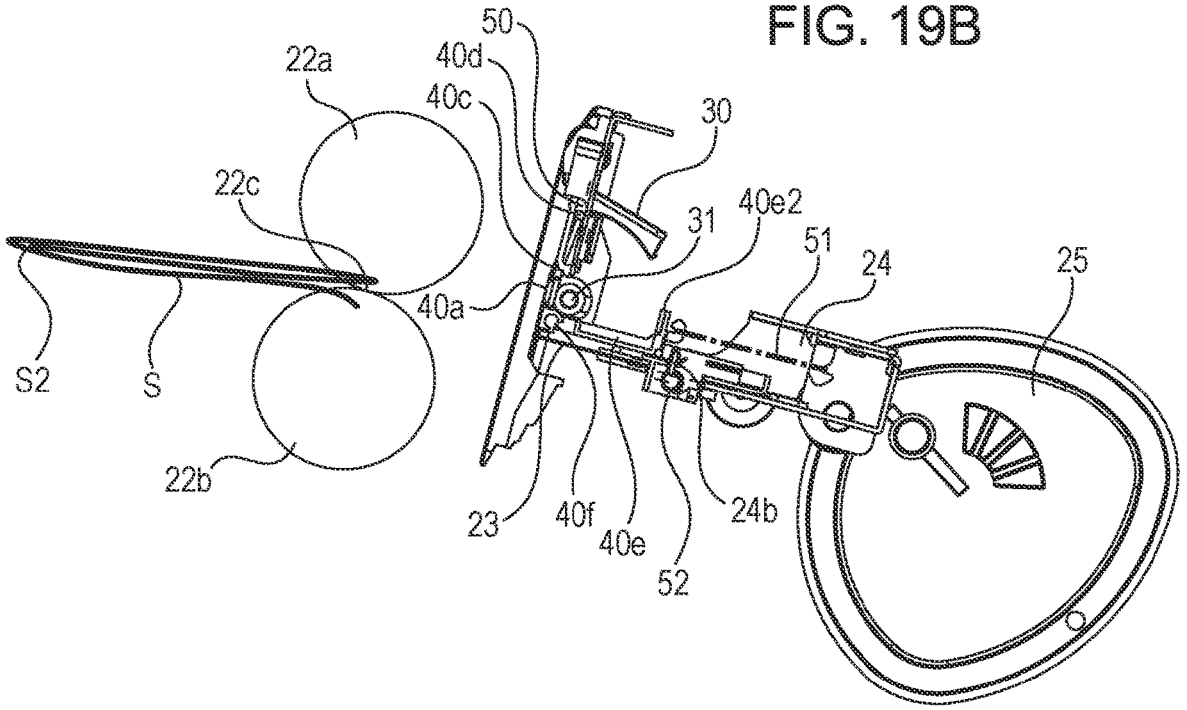

When the cam member 25 is further rotated to move the blade carrier 24 in the return direction, the abutting part 40*a* of the blade guide member 40 abuts against the turning shaft 31, and thus the blade guide member 40 is returned to its home position, where further movement of the blade guide member 40 in the return direction is regulated (FIG. 19A). When the cam member 25 is further rotated, only the folding blade is moved in the return direction to be returned to its home position with the blade guide member 40 maintained at its home position (FIG. 19B).

As described above, when the blade carrier 24 is moved in the return direction, the folding blade 23 and blade guide member 40 are moved in the return direction simultaneously, and the blade guide member 40 reaches its home position before the blade carrier 24 and folding blade 23 reach their home positions. That is, the blade guide member 40 retracts from the sheet drawn by the folding roller pair 22 and discharge roller 17*b* earlier than the folding blade 23. This reduces the conveyance load that the blade guide member 40 applies to the sheet S drawn by the discharge roller 17*b* and the like.

<Arrangement Relation Between Blade Guide Member and Pressing Guide Member>

In the present embodiment, two blade guide members 40 are arranged at predetermined positions in the sheet width direction, as illustrated in FIG. 4 which is a schematic plan view of the folding processing apparatus F. The folding blade 23 according to the present embodiment has four thrust distal ends 23*a*. The thrust distal ends 23*a* are formed so as to protrude toward the thrust side and spaced equally in the sheet width direction. The thrust distal ends 23*a* thrust the sheet to the nip part 22*c* of the folding roller pair 22 to fold the sheet. The blade guide members 40 are disposed above two of the four thrust distal ends 23*a* that are located on both sides in the sheet width direction. Thus, the sheet S thrust by the folding blade 23 is guided at the folded end portion S2 by the blade guide members 40 on both sides in the sheet width direction.

The blade guide member 40 is desirably provided above all the four thrust distal ends 23*a* so as to reliably guide the folded end portion S2 of the sheet to the nip part 22*c*; however, this results in an increase in the number of components. In the present embodiment, as described above, the blade guide members 40 are provided for the two thrust distal ends 23*a* formed on both sides in the sheet width direction, reducing the number of components. The folded end portion S2 of the sheet S pushed by the folding blade 23 in the second folding processing is more likely to be curled at end portions in the sheet width direction than at the center portion, so that by guiding the end portions with the blade guide members 40 on both sides to the nip part 22*c*, the curling can be effectively prevented.

The two blade guide members 40 are disposed not on both end portions in the sheet width direction but above the thrust distal ends 23*a* positioned slightly close to the center portion from the both end portions. This is because it is more effective for the thrust distal ends 23*a* to thrust a part of the sheet slightly close to the center from the end portions in the sheet width direction, and the blade guide members 40 are arranged so as to correspond to the thus arranged thrust distal ends 23*a*.

The pressing guide members 30 according to the present embodiment are arranged outside the two blade guide members 40 in the sheet width direction. Specifically, two pressing guide members 30 are arranged at an interval substantially the same as the width of the minimum size sheet that can be processed by the folding processing apparatus F so as to be able to press and guide both ends of the sheet in the width direction when folding the minimum size sheet. In the present embodiment, there is provided, in addition to the two pressing guide members 30 that can press and guide the sheet both ends, a pressing guide member 30 that can press and guide the sheet center in the width direction. That is, three pressing guide members 30 are provided in total. More specifically, the minimum size of the sheet that can be processed by the folding processing apparatus F according to the present embodiment is A4 size, and the length of the typical A4 size sheet in the short direction is 210 mm. The length in the sheet width direction of each of the two pressing guide members 30 that can press and guide both ends of the sheet in the width direction is set to 18 mm, and the length between the outside ends of the two pressing guide members 30 is set to 226 mm which is longer than the width of the A4 size sheet. As a result, the end portion in the width direction of the A4 size sheet covers a part of the surface of each of the pressing guide member 30 on both sides on the side close to the center by 10 mm. The maximum size of the sheet that can be processed by the folding processing apparatus F is A3 size, and the length of the typical A3 size sheet in the short direction is 297 mm. Since the length between the outside ends of the two pressing guide members 30 that can press and guide both ends of the sheet in the width direction is thus set larger than the width of the minimum size sheet, guide effect can be provided for end portions of the maximum size sheet.

When the sheet that has been subjected to the first folding processing is switchback-conveyed, the sheet is guided to the sheet stacking tray 21 with the folded end portion S2 of the sheet pressed by the pressing guide member 30 as described above. At this time, it is effective to press both end potions of the sheet in the width direction in order to prevent curling. Thus, the two pressing guide members 30 are disposed outside the blade guide members 40 in the sheet width direction. In the present embodiment, the two pressing guide members 30 on both sides in the sheet width direction are arranged at an interval substantially the same as the width of the minimum size sheet, and the blade guide members 40 are positioned inside the two pressing guide members 30 and arranged at an interval smaller than the width of the minimum size sheet.

<System Configuration of Folding Processing Apparatus>

The following describes the system configuration of the folding processing apparatus F.

FIG. 20 is a block diagram illustrating the system configuration of the folding processing apparatus F. As illustrated in FIG. 20, the folding processing apparatus F has a control part 60 including a CPU (not illustrated), a memory (not illustrated), and a timer (not illustrated).

The control part 60 is connected with a folding roller motor 61 (second motor) for rotating the folding roller pair 22, a discharge roller motor 62 for rotating the discharge roller 17*b*, and a regulating stopper motor 63 for operating the sheet elevating/lowering mechanism 27 for elevating/lowering the regulating stopper 26. The control part 60 is further connected with a cam motor 64 for driving the cam member 25, a pressing guide motor 33 (first motor) for turning the pressing guide member 30, and an aligning plate motor 65 for moving the aligning plates 28*a* and 28*b*.

The control part 60 is further connected with an optical sensor 90*c* for detecting that the pressing guide member 30 is located at the retracting position and an optical sensor 90*d* for detecting that the pressing guide member 30 is located at the guide position. The control part 60 is further connected with an optical sensor 91*b* for detecting that the folding roller pair 22 is located at its home position and an aligning plate sensor 66 for detecting that the aligning plates 28*a* and 28*b* are located at their home positions.

<Sheet Folding Processing Control>

The following describes control performed by the control part 60 in the sheet folding processing. The control part 60 controls the drive of the folding roller motor 61 for driving the folding roller pair 22 into rotation, the drive of the discharge roller motor 62 for driving the discharge roller 17*b* into rotation, and the drive of the regulating stopper motor 63 for operating the sheet elevating/lowering mechanism 27 that elevates/lowers the regulating stopper 26, according to the procedure of the flowchart illustrated in FIGS. 21 and 22. Similarly, the control part 60 controls the drive of the cam motor 64 for driving the cam member 25 that operates the blade carrier 24 and the drive of the pressing guide motor 33 for turning the pressing guide member 30.

Figure 21:
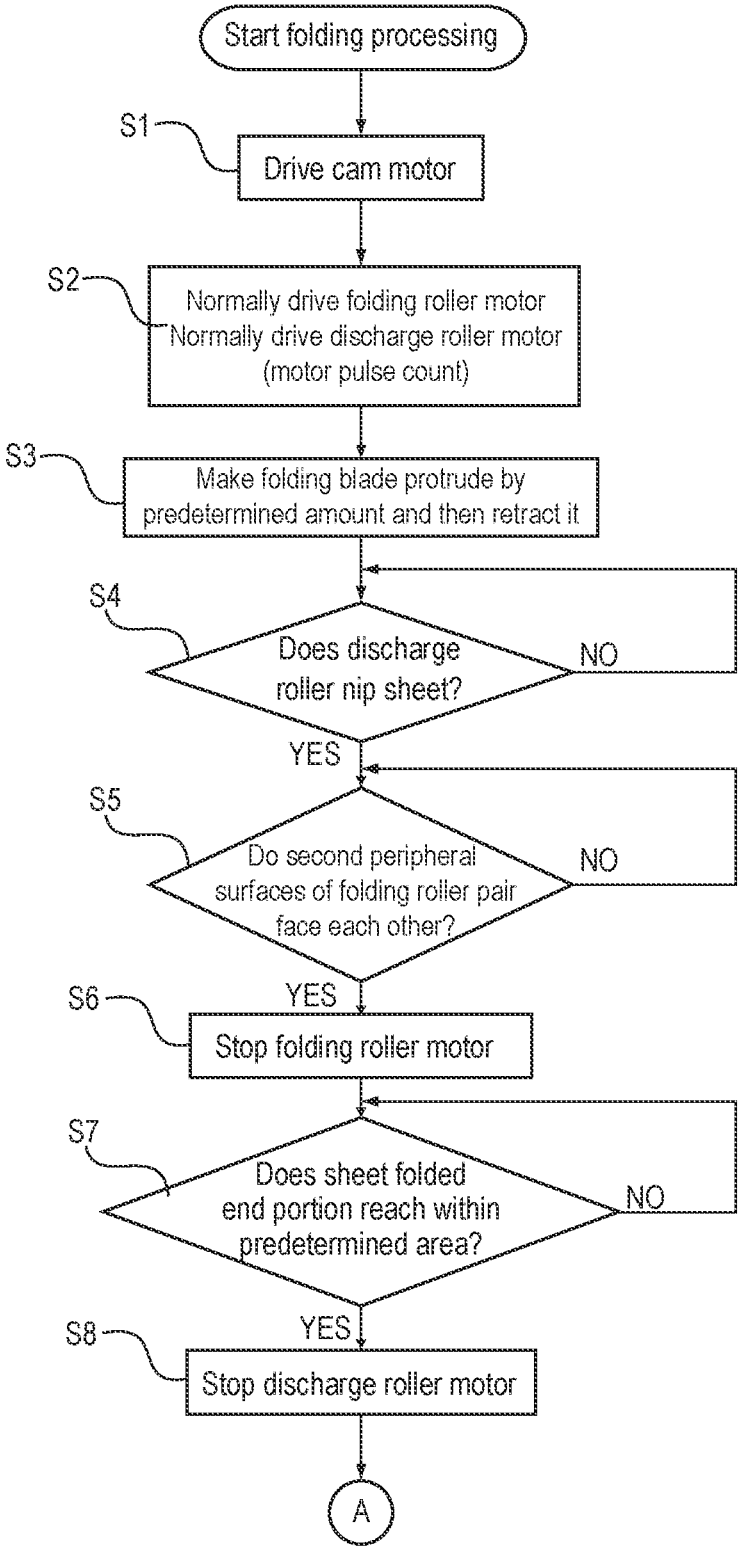
FIG. 21 is a flowchart illustrating the folding operation in the sheet folding processing apparatus.
Figure 22:
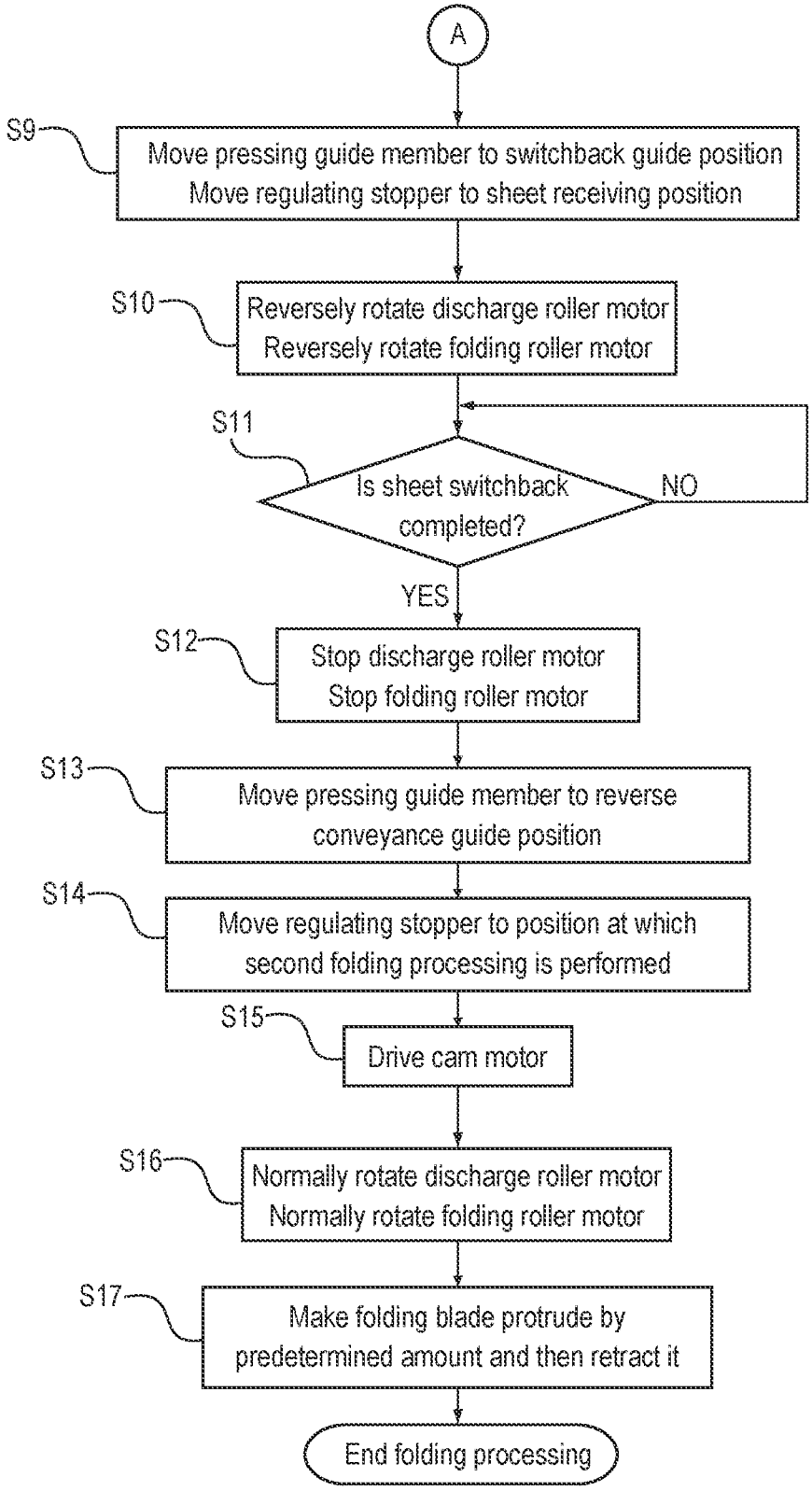
FIG. 22 is a flowchart illustrating the folding operation in the sheet folding processing apparatus.

FIGS. 21 and 22 are flowcharts illustrating a drive control procedure to be taken when: the sheet S is conveyed to the sheet stacking tray 21; the sheet leading end abuts against the regulating stopper 26 stopped at a predetermined position; and folding processing is performed in a state where the first folding position is at a position aligned with the folding blade 23.

Upon execution of the folding processing, the cam motor 64 is driven to move the blade carrier 24 in the thrust direction, and the folding blade 23 abuts against the first folding position of the sheet S and thrusts the same to the nip part 22*c* (S1). At the same time, the folding roller motor 61 and discharge roller motor 62 are driven to normally drive the folding roller pair 22 and discharge roller 17*b* (S2). The above motors are each a pulse motor, and when the motor is driven, the number of drive pulses thereof is counted.

When the rotation of the cam member 25 causes the folding blade 23 to protrude by a predetermined amount to a position at which it thrusts the first folding position of the sheet S to the nip part 22*c*, the traveling direction of the folding blade 23 is reversed, and the folding blade 23 is moved in the return direction to be returned to its home position (S3).

The sheet S thrust into the nip part 22*c* of the folding roller pair 22 by the folding blade 23 is subjected to folding processing while being held and conveyed by the folding roller pair 22 and is conveyed by the discharge roller 17*b* constituting a sheet conveying unit together with the folding roller pair 22. When the sheet is held and conveyed by the discharge roller 17*b* (S4), the folding roller motor 61 is stopped when the second roller surfaces 22*a*3 and 22*b*3 of the respective folding rollers 22*a* and 22*b* face each other (S4, S5). As a result, a nipping state of the sheet by the folding roller pair 22 is released, and the sheet is conveyed by the discharge roller 17*b*. At this time, the sheet is conveyed by the discharge roller 17*b* while being guided by the second roller surfaces 22*a*3 and 22*b*3 having a small friction coefficient. Although whether the sheet has been conveyed to the discharge roller 17*b* and whether the second roller surfaces 22*a*3 and 22*b*3 of the folding roller pair 22 have faced each other are determined based on the motor pulse count in the present embodiment, the drive of the motor may be controlled according to a detection result obtained by other means, e.g., a sensor for detecting the sheet.

Then, when the folded end portion S2 of the sheet S being conveyed reaches within a predetermined area (S7), the drive of the discharge roller motor 62 is stopped to stop sheet conveyance (S8). The predetermined area refers to an area surrounded by the turning locus L3 of the pressing guide member 30 and the guide surface 21*a* of the sheet stacking tray 21 (see FIG. 14A). The sheet S is stopped so as to make the folded end portion S2 fall within the above area, whereby when the pressing guide member 30 is turned, the sheet S can be reliably pressed by the pressing part 30*c* in a direction that it is switch-back conveyed (see FIG. 14B), and the folded end portion S2 of the sheet to be switchback-conveyed can be guided by the guide part 30*b* (see FIG. 14C).

After the folded end portion S2 of the sheet S is stopped within the above area, the pressing guide motor 33 is driven to turn the pressing guide member 30 so as to cause the pressing guide member 30 to reach the position illustrated in FIG. 14C through the guide position (S9). Along with the turning of the pressing guide member 30, the regulating stopper motor 63 is driven to move the regulating stopper 26 to a position that can receive the sheet S to be switchback-conveyed.

Then, the control part 60 reversely drives the discharge roller motor 62 and folding roller motor 61 after the pressing guide member 30 is thus turned (S10). This causes the discharge roller 17*b* and folding roller pair 22 to be reversely rotated to switchback-convey the sheet S. At this time, the sheet is guided by the pressing guide member 30 as described above, so that the sheet is switchback-conveyed toward the regulating stopper 26 of the sheet stacking tray 21 without sheet feeding failure.

When the control part 60 does not receive the detection signal of the flag 90*b* from the optical sensor 90*d* within a predetermined time period from when the pressing guide motor 33 is reversely driven in the course of moving the pressing guide member 30 located at the retracting position to the guide position, there is a possibility that the pressing guide member 30 is caught by the sheet to fail to turn. When the folding roller motor 61 is driven in this situation, the pressing guide member 30 and folding roller pair 22 may interfere with each other to cause damage. In such a case, the control part 60 stops driving the folding roller motor 61 and pressing guide motor 33 and issues an error message. The error message is issued in the same way as described in the following description of initialization control. The above situation can occur when rigidity of the sheet is equivalent or more to the turning force of the pressing guide member 30 in a case where the basis weight of the sheet to be folded is large (cardboard, or large number of sheets to be folded).

The discharge roller motor 62 and folding roller motor 61 are driven to switchback-convey the sheet S, and the sheet S that has passed through the nip part 22*c* of the folding roller pair 22 falls onto the regulating stopper 26, whereby the operation of switchback-conveyance is completed (S11). At this timing, the discharge roller motor 62 and folding roller motor 61 stop being driven are stopped driving (S12). Whether the switchback conveyance of the sheet S has been completed may be determined based on the count values of the numbers of driving pulses of the discharge roller motor 62 and folding roller motor 61, i.e., based on whether the sheet S has been conveyed by a predetermined amount.

Then, the pressing guide motor 33 is driven to move the pressing guide member 30 to a position (reverse conveyance guide position) slightly protruding to the sheet conveying path 20 side from the guide surface 21*a* (S13). At this time, the speed at which the pressing guide member 30 is returned from the guide position (see FIG. 14C) to the reverse conveyance guide position is set higher than the speed at which the pressing guide member 30 is moved from the retracting position to the guide position. When the pressing guide member 30 is moved from the retracting position to the guide position, it is turned at a reduced speed since it presses the sheet S in a stopped state for switchback conveyance and changes its direction, while when the pressing guide member 30 is moved from the guide position to the reverse conveyance guide position, it is turned at a high speed for performing the subsequent operation earlier.

Then, the regulating stopper motor 63 is driven to move the second folding position of the sheet S to a position aligned with the folding blade 23 (S14). In this state, the cam motor 64, folding roller motor 61, and discharge roller motor 62 are driven to perform the second folding operation (S15 to S17).

Although the motors are individually provided for individual members in the present embodiment, it is possible to use a common motor to drive the members by switching the drive using a clutch or the like.

<Initialization Control>

Figure 25:
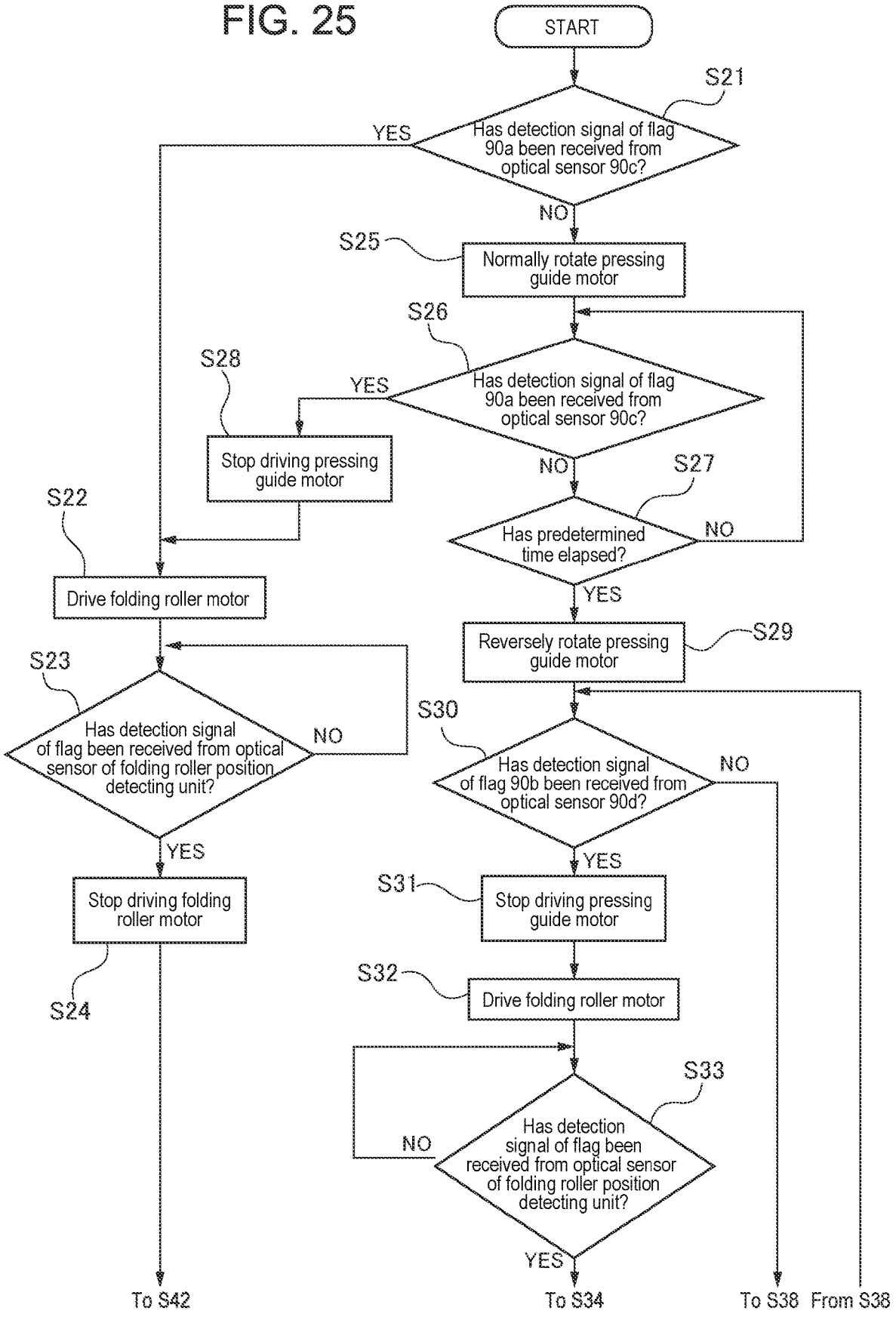
FIG. 25 is a flowchart illustrating initialization control.
Figure 26:
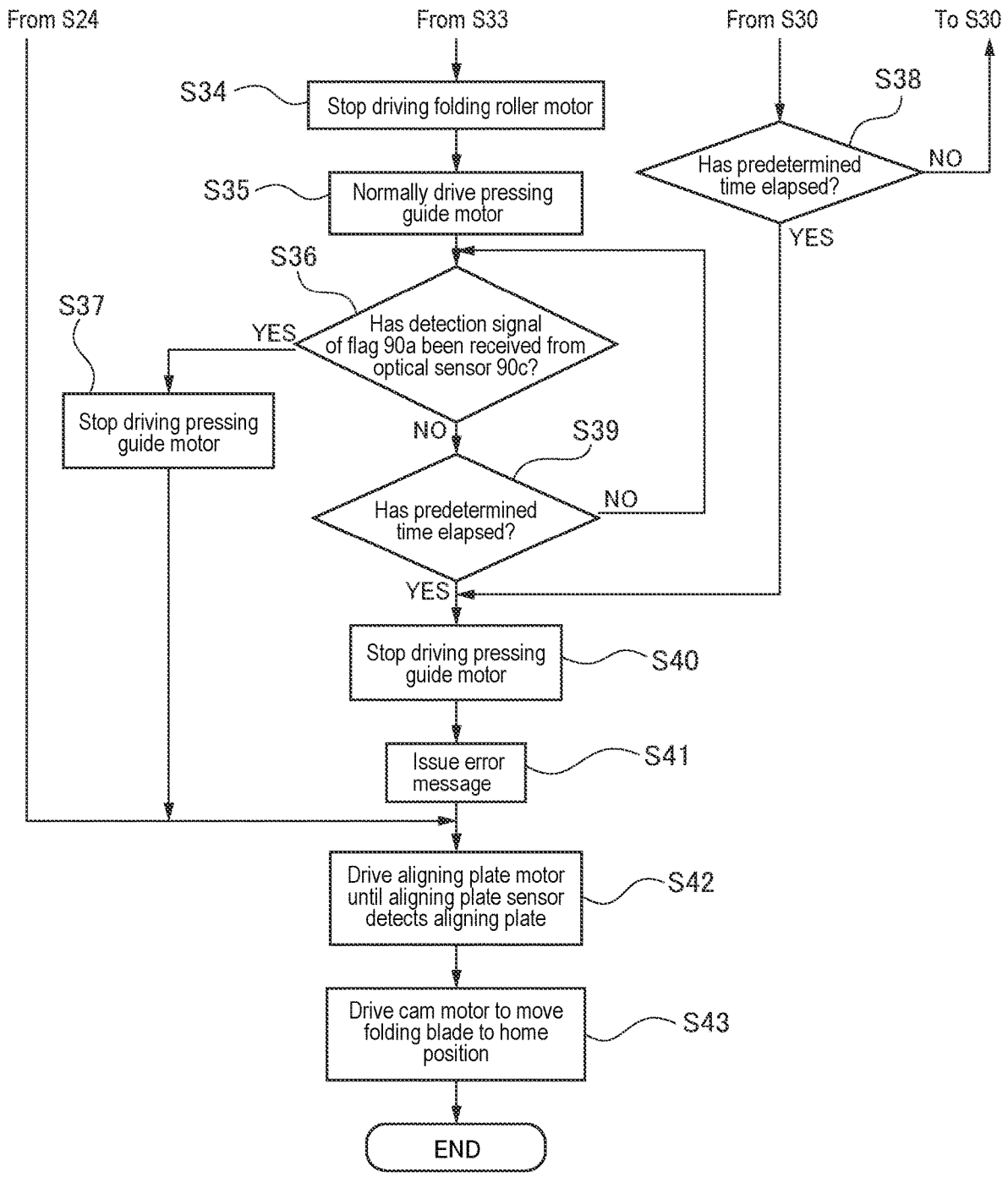
FIG. 26 is a flowchart illustrating the initialization control.

The following describes initialization control for positioning the pressing guide member 30, folding roller pair 22, aligning plates 28*a*, 28*b*, and folding blade 23 to their homo positions with reference to the flowcharts illustrated in FIGS. 25 and 26. The control part 60 performs initialization control when the sheet processing apparatus B is powered on or when a jam is solved.

As illustrated in FIGS. 25 and 26, the control part 60 first determines whether it has received the detection signal of the flag 90*a* from the optical sensor 90*c* of the pressing guide position detecting unit 90 (S21). When the control part 60 has received the detection signal from the optical sensor 90*c*, the pressing guide member 30 is located at its home position (retracting position). In this case, the control part 60 drives the folding roller motor 61 until it receives the detection signal of the flag 91*a*1 from the optical sensor 91*b* of the folding roller position detecting unit 91 (S22, S23, S24). As a result, the folding roller pair 22 is rotated to its home position.

On the other hand, in step S1, when the control part 60 has not received the detection signal of the flag 90*a* from the optical sensor 90*c*, the pressing guide member 30 is not located at the retracting position but located at any other position in the sheet conveying path 20 including the guide position. This situation can occur when the power of the sheet processing apparatus B is turned off in the middle of the folding processing or when a jam occurs. Then, the control part 60 normally drives the pressing guide motor 33 to turn the pressing guide member 30 toward the retracting position (S25). Thereafter, when receiving the detection signal of the flag 90*a* from the optical sensor 90*c* within a predetermined time period from the normal-drive of the pressing guide motor 33, the control part 60 stops driving the pressing guide motor 33 (S26, S27, S28). As a result, the pressing guide member 30 is stopped at the retracting position. Thereafter, the control part 60 performs the above-described steps S22 to S24 to move the folding roller pair 22 to its home position.

Figure 27A:
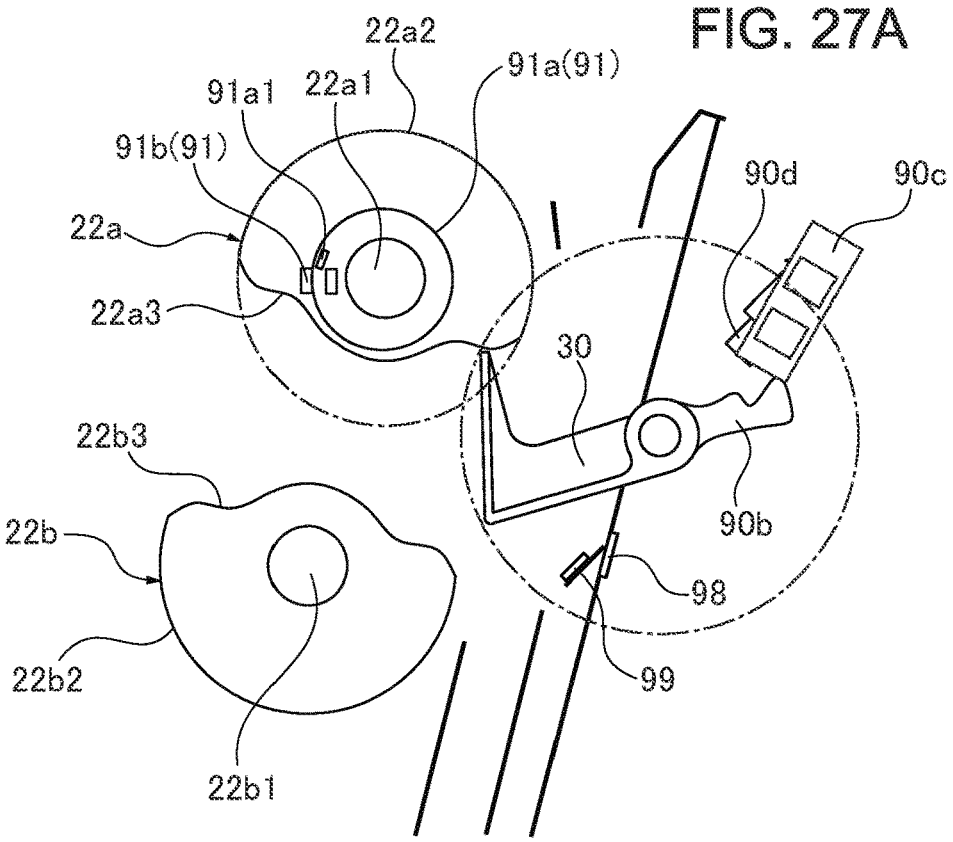
FIGS. 27A and 27B are views explaining an operation of the folding roller pair and pressing guide member in the initialization control.

In step S27, when the control part 60 does not receive the detection signal of the flag 90*a* from the optical sensor 90*c* within a predetermined time period from the normal-drive of the pressing guide motor 33, it is assumed that the pressing guide member 30 interferes with the folding roller 22*a*, which specifically indicates a situation where, as illustrated in FIG. 27A, the folding roller pair 22 is not located at its home position, and the first roller surface 22*a*2 of the folding roller 22*a* is located on the moving locus of the pressing guide member 30, so that the pressing guide member 30 and folding roller 22*a* interfere with each other to impede turning of the pressing guide member 30.

A not-shown drive transmission mechanism that transmits drive force of the pressing guide motor 33 to the turning shaft 31 is provided with a torque limiter, so that transmission of the drive force to the pressing guide member 30 is interrupted when the pressing guide motor 33 is continuously driven in the above interference state. Thus, there is a low possibility that the pressing guide member 30 and folding roller 22*a* are damaged due to the pressing of the pressing guide member 30 against the folding roller 22*a*. However, in such interference state, the pressing guide member 30 cannot be returned to its home position.

Figure 27B:
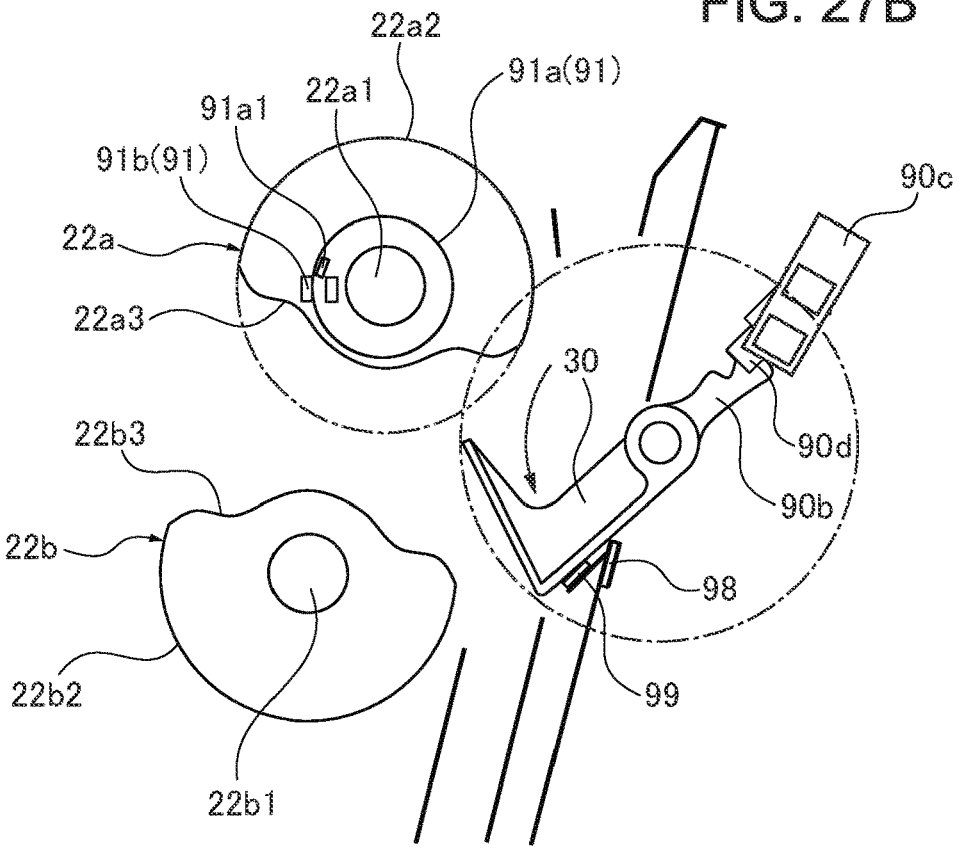
Figure 28A:
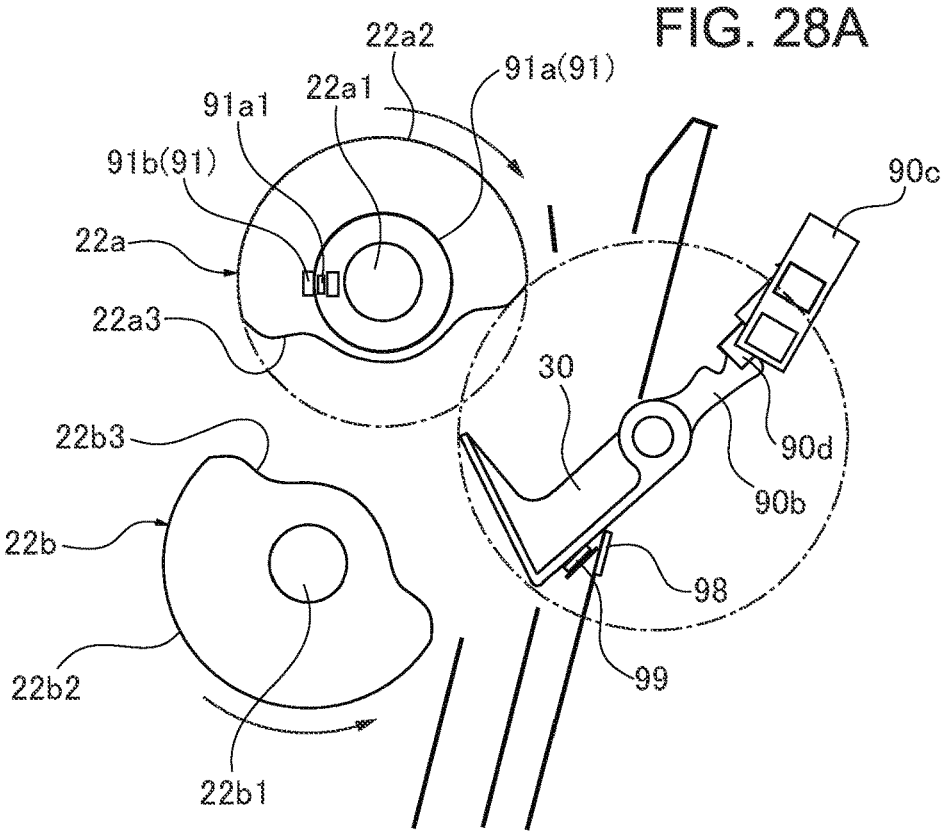
FIGS. 28A and 28B are views explaining the operation of the folding roller pair and pressing guide member in the initialization control.

Thus, as illustrated in FIG. 27B, the control part 60 reversely drives the pressing guide motor 33 until it receives the detection signal of the flag 90*b* from the optical sensor 90*d* to move the pressing guide member 30 to the guide position (S29, S30, S31). Then, the control part 60 drives the folding roller motor 61 until it receives the detection signal of the flag 91*a*1 from the optical sensor 91*b* of the folding roller position detecting unit 91 to move the folding roller pair 22 to its home position (S32, S33, S34). At this time, the pressing guide member 30 is located at the guide position and is thus not located on the rotation locus of the first roller surface 22*a*2 of the folding roller 22*a*, allowing the folding roller 22*a* to be moved to its home position without interfering with the pressing guide member 30 (FIG. 28A).

Figure 28B:
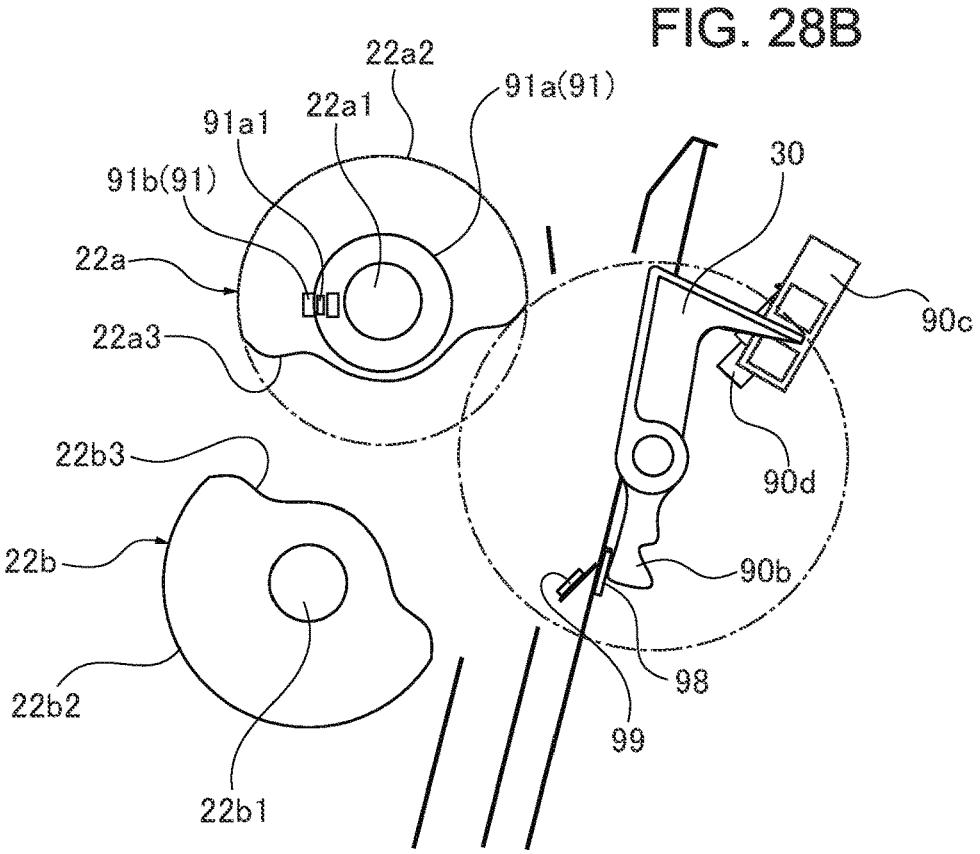

Then, the control part 60 normally drives the pressing guide motor 33 until it receives the detection signal of the flag 90*a* from the optical sensor 90*c* (S35, S36, S37). At this time, the folding roller pair 22 is located at its home position, allowing the pressing guide member 30 to be moved to its home position without interfering with the folding roller 22*a*. As a result, as illustrated in FIG. 28B, the pressing guide member 30 is returned to its home position (retracting position).

In step S30 or step S36, when the control part 60 does not receive the detection signal of the flag 90*a* or 90*b* from the optical sensor 90*c* or 90*d* within a predetermined time period from when it drives the pressing guide motor 33, a failure of the optical sensor 90*c* or 90*d* or a situation where the pressing guide member 30 bites into the first roller surface 22*a*2 of the folding roller 22*a* and thus cannot be moved is assumed. In this case, the control part 60 stops the drive of the pressing guide motor 33 and issues an error message (S38, S39, S40, S41).

How to issue the error message is not particularly limited as long as a user can recognize the error and may include the following: error information is displayed on a display of a not-shown operation panel (provided in the image forming apparatus A or sheet processing apparatus B) for a user to make settings about image formation and sheet processing; and error information is displayed on a display of an external device such as a personal computer connected to the image forming system over a network.

Then, the control part 60 drives the aligning plate motor 65 until the aligning plate sensor 66 detects the aligning plates 28*a* and 28*b* to move the aligning plates 28*a* and 28*b* to their home positions (S42). Subsequently, the control part 60 drives the cam motor 64 to move the folding blade 23 to its home position (S43). Thereafter, the control part 60 ends the initialization processing.

The reason that the movement of the folding blade 23 to its home position is performed at the end of the initialization control is as follows. That is, the folding blade 23 is configured to reciprocate with rotation of the cam member 25, so that, depending on the position of the folding blade 23 at the start of the initialization control, driving the cam motor 64 may cause the distal end of the folding blade 23 to protrude toward the sheet conveying path 20 side from the guide surface 21*a* of the sheet stacking tray 21. In this case, unless the folding roller pair 22 or pressing guide member 30 is located at its home position, the folding blade 23 may interfere with the folding roller pair 22 or pressing guide member 30 to be damaged. To prevent such damage, the operation of moving the folding blade 23 to its home position is performed at the end of the initialization control.

<Other Embodiments>

Although the pressing guide member 30 has an L-shape in the above-described embodiment, the present invention is not limited thereto; the pressing guide member 30 may be, for example, a bar-like member.

Further, in the above-described embodiment, the folding roller 22*b* has the first roller surface 22*b*2 having a circular outer peripheral surface with a constant diameter and the second roller surface 22*b*3 with a diameter smaller than that of the first roller surface 22*b*2. However, the folding roller 22*b* may be constituted by a roller having a constant diameter, for example, a circular rubber roller as long as it can be brought into pressure contact with the first roller surface 22*a*2 of the folding roller 22*a* to form a nip part.

Further, in the above-described embodiment, the regulating stopper 26 that makes the leading end of the carried-in sheet in the conveying direction abut thereagainst for regulation is disposed at the lower end of the sheet stacking tray 21 so as to be elevated and lowered along the sheet stacking tray 21 by the sheet elevating/lowering mechanism 27. Alternatively, as another embodiment, roller pairs for conveying the sheet may be provided on the upstream and downstream sides in the sheet conveying direction of the sheet stacking tray 21 with the folding blade 23 and folding roller pair 22 therebetween. In this case, the sheet S that has been subjected to the first folding processing can be switch-back-conveyed (returned) to either the upstream or downstream side of the sheet stacking tray 21 in the sheet conveying direction with the folding blade 23 and folding roller pair 22 therebetween.

The invention claimed is:

1. A sheet folding apparatus that folds a sheet, comprising:

a stacking part configured to stack a sheet;

a folding roller pair constituted of a first folding roller and a second folding roller brought into pressure contact with the first folding roller and configured to nip a predetermined position of the sheet stacked on the stacking part to fold the sheet and to convey the folded sheet in a feed-out direction and a returning direction with respect to the stacking part; and a guide member configured to guide the folded sheet being returned to the stacking part by the folding roller pair, wherein the first folding roller has a first peripheral surface and a second peripheral surface with a radius smaller than that of the first peripheral surface, and the guide member is disposed so as to be movable between a guide position where it guides the folded sheet being returned to the stacking part by the folding roller pair and a retracting position located outside the rotation locus of the first peripheral surface of the first folding roller, the guide member moving from the guide position to the retracting position while passing within the rotation locus of the first peripheral surface of the first folding roller.

2. The sheet folding apparatus according to claim 1, further comprising:

a detection unit configured to detect the guide member at the outside of the rotation locus of the first peripheral surface of the first folding roller; and a control part configured to control the folding roller pair upon rotation thereof so as to rotate the first folding roller when the detection unit detects the guide member and so as not to rotate the first folding roller when the detection unit does not detect the guide member.

3. The sheet folding apparatus according to claim 1, further comprising:

a first detection sensor configured to detect the guide member at the outside of the rotation locus of the first peripheral surface of the first folding roller on the retracting position side of the guide member;

a second detection sensor configured to detect the guide member at the outside of the rotation locus of the first peripheral surface of the first folding roller on the guide position side; and a control part configured to control movement of the guide member upon moving the guide member toward the retracting position so as to move the guide member in a direction toward the guide position that is different from a direction toward the retracting position when the first detection sensor does not detect the guide member within a predetermined time period from when the guide member starts moving toward the retracting position.

4. The sheet folding apparatus according to claim 3, wherein the control part causes the first peripheral surface of the first folding roller to rotate to the outside of the moving locus of the guide member when the second detection sensor detects the guide member that has been moved toward the guide position and then causes the guide member to move toward the retracting position.

5. The sheet folding apparatus according to claim 1, wherein the first folding roller is a single roller having a length larger than the maximum width of a sheet to be conveyed by the folding roller pair.

6. A sheet folding apparatus that applies folding processing to a sheet, comprising:

a conveying path having a guide surface for guiding a sheet being conveyed;

a first rotor having a first peripheral surface with a constant radius and a second peripheral surface having a radius smaller than that of the first peripheral surface;

a second rotor configured to be rotated in sync with the first rotor and brought into pressure contact with the first peripheral surface of the first rotor to form a nip part, the second rotor being rotated while holding a sheet conveyed to the conveying path at the nip part to convey the sheet in a first direction to apply the folding processing to the sheet and rotated while holding the sheet that has been subjected to the folding processing to switchback-convey the sheet in a second direction opposite to the first direction; and a guide member configured to abut, in the conveying path, against the sheet that has been subjected to the folding processing and moved in the second direction while being held by the nip part, to guide one end portion of the sheet to the side of the conveying path where the other end portion of the sheet is positioned, the guide member being configured to be turned between a first position substantially flush with the guide surface or separated from the conveying path than the guide surface and a second position inclusive, abutting against the sheet that has been subjected to the folding processing and moved in the second direction while being held by the nip part in the conveying path and configured to enter an area between a rotation locus of the first peripheral surface and a rotation locus of the second peripheral surface when being turned from the first position to the second position and then to abut against the sheet at the second position outside the area.

7. The sheet folding apparatus according to claim 6, further comprising:

a first detection part configured to detect that the guide member is located at the first portion;

a second detection part configured to detect that the first rotor is located at a position not contacting the guide member located within the area;

a first motor configured to drive the guide member, the first motor being configured to be rotated in a first rotation direction to turn the guide member from the second position to the first position and to be rotated in a second rotation direction opposite to the first rotation direction to turn the guide member from the first position to the second position;

a second motor configured to drive the first rotor; and a control part configured to control the first and second motors, wherein, in the course of moving the guide member located in the conveying path to the first position, the control part has a mode of rotating the first motor in the second rotation direction when the first detection part does not detect that the guide member is located at the first position within a predetermined time period from when the first motor is rotated in the first rotation direction, rotating the second motor until the second detection part detects that the first rotor is located at the position not contacting the guide member, and then rotating the first motor in the first rotation direction.

8. The sheet folding apparatus according to claim 7, further comprising a third detection part configured to detect that the guide member is located at the second position, wherein in the above mode, when the first detection part does not detect that the guide member is located at the first position within a predetermined time period from when the first motor is rotated in the first rotation direction, the control part causes the first motor to rotate in the second rotation direction until the third detection part detects that the guide member is located at the second position, causes the second motor to rotate until the second detection part detects that the first rotor is located at the position not contacting the guide member, and then causes the first motor to rotate in the first rotation direction.

9. The sheet folding apparatus according to according to claim 8, wherein the third detection part has a flag configured to be turned in sync with the guide member and an optical sensor configured to detect the flag when the guide member is located at the second position, and when the guide member is turned from the second position to the first position, the flag abuts against a regulating part for regulating the turning of the flag to position the guide member at the first position.

10. The sheet folding apparatus according to claim 8, wherein in the above mode, the control part issues an error message when the third detection part does not detect that the guide member is located at the second position within a predetermined time period from when the first motor is rotated in the second rotation direction.

11. The sheet folding apparatus according to claim 8, wherein the control part stops driving the second motor when the third detection part does not detect that the guide member is located at the second position within a predetermined time period from when the first motor is rotated in the second rotation direction in the course of moving the guide member located at the first position to the second position.

12. The sheet folding apparatus according to claim 7, wherein at power-on, the control part controls the first and second motors so as to locate the guide member at the first position and to locate the first rotor at the position not contacting the guide member.

13. The sheet folding apparatus according to claim 6, wherein a sheet is subjected to the folding processing at a plurality of positions such that the one end portion of the sheet is inside the sheet that has been subjected to the folding processing.

14. An image forming system comprising:

an image forming apparatus for forming an image on a sheet; and a sheet folding apparatus as claimed in claim 1 for applying folding processing to a sheet fed from the image forming apparatus.

* * * * *